US010526802B2

(12) United States Patent
Wylde

(10) Patent No.: US 10,526,802 B2
(45) Date of Patent: Jan. 7, 2020

(54) SCAFFOLD EXTENSIONS

(71) Applicant: Curt Wylde, Diamond Springs, CA (US)

(72) Inventor: Curt Wylde, Diamond Springs, CA (US)

( * ) Notice: Subject to any disclaimer, the term of this patent is extended or adjusted under 35 U.S.C. 154(b) by 0 days.

(21) Appl. No.: 16/125,735

(22) Filed: Sep. 9, 2018

(65) Prior Publication Data

US 2019/0003191 A1 Jan. 3, 2019

Related U.S. Application Data

(63) Continuation of application No. 15/393,121, filed on Dec. 28, 2016, now abandoned.

(51) Int. Cl.
*E04G 1/15* (2006.01)

(52) U.S. Cl.
CPC ..... *E04G 1/15* (2013.01); *E04G 2001/157* (2013.01)

(58) Field of Classification Search
CPC ..... E04G 1/15; E04G 2001/157
See application file for complete search history.

(56) References Cited

U.S. PATENT DOCUMENTS 698,762 A * 4/1902 Tove
2,290,535 A * 7/1942 Cavins ..... E04G 1/00 182/186.9
2,305,563 A * 12/1942 Uecker ..... E04G 1/14 182/115
2,359,583 A * 10/1944 Reiner ..... E04G 1/14 16/35 R
2,897,013 A * 7/1959 Delp ..... E04G 7/16 182/108

(Continued)

FOREIGN PATENT DOCUMENTS

WO WO2011107573 9/2011
WO WO2012056435 5/2012

OTHER PUBLICATIONS

Safway Group Holding LLC, "Sectional Scaffold Product Selection Guide", dated Jul. 2016.

*Primary Examiner* — Alvin C Chin-Shue
(74) *Attorney, Agent, or Firm* — Jim H. Salter; Inventive Law Inc.

(57) ABSTRACT

An apparatus and method for manufacturing and using segmented and integrated solutions for scaffold extensions are disclosed. An example embodiment comprises: a standard scaffold support component including at least one post element; and a scaffold extension including a runner element and a bracing element coupled to the post element of the standard scaffold support component to produce a modified scaffold support component with a scaffold extension. The scaffold extension can be a one-sided scaffold extension or a two-sided scaffold extension. The scaffold extension can be coupled to the post element of the standard scaffold support component with a hinged and swingable coupling. The scaffold extension can be integrated into the post element of the standard scaffold support component. The scaffold extension can be integrated into a retrofit scaffold support component configured to be coupled to the standard scaffold support component.

8 Claims, 20 Drawing Sheets

(56) References Cited

U.S. PATENT DOCUMENTS

| | | | | | |
|---|---|---|---|---|---|
| 3,084,761 | A | * | 4/1963 | Robertson | E04G 1/14 182/178.6 |
| 3,223,370 | A | * | 12/1965 | Pignon | E04G 1/15 248/214 |
| 3,493,208 | A | * | 2/1970 | Sato | E04G 5/06 182/186.9 |
| 3,566,991 | A | | 3/1971 | Proulx | |
| 3,684,057 | A | * | 8/1972 | Eppinette | E04G 5/10 182/106 |
| 3,684,058 | A | * | 8/1972 | Brown | E04G 1/14 182/132 |
| 2,923,374 | A | | 2/1980 | Harwell | |
| 4,452,337 | A | | 6/1984 | Atzinger | |
| 4,560,074 | A | | 12/1985 | Manning | |
| 4,641,728 | A | | 2/1987 | McCabe | |
| 4,809,814 | A | | 3/1989 | St.-Germain | |
| 5,445,281 | A | | 8/1995 | Hung | |
| 6,983,856 | B1 | | 1/2006 | Burks | |
| 7,014,011 | B1 | | 3/2006 | Alexander | |
| 2008/0035594 | A1 | | 2/2008 | Crowder | |
| 2015/0184402 | A1 | | 7/2015 | Gardner | |

* cited by examiner

SCAFFOLD EXTENSIONS

PRIORITY APPLICATION

This is a continuation patent application of co-pending patent application, Ser. No. 15/393,121, filed Dec. 28, 2016 by the same applicant. This present patent application draws priority from the referenced patent application. The entire disclosure of the referenced patent application is considered part of the disclosure of the present application and is hereby incorporated by reference herein in its entirety.

BACKGROUND

Technical Field

The present disclosure generally relates to modular scaffolding structures, particularly temporary or permanent scaffolding structures. More specifically, the present disclosure relates to modular scaffolding extension structures.

Copyright

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the disclosure and data as described below and in the drawings that form a part of this document: Copyright 2015-2018 Curt Wylde, All Rights Reserved.

Related Art

Scaffolding structures and elements of various types are well-known. For example, in applications for building construction or renovation or similar uses, these scaffolding structures can include a plurality of vertical struts, connected by transverse elements, forming the load-bearing structure of the scaffolding. On this load-bearing structure are then placed platforms for walking or the support of building materials, as well as safety barriers for workers and/or to prevent the fall of materials. The scaffolding assembly procedure is usually a complex and relatively long activity, requiring the use of a large number of scaffold parts, and a large number of assemblers for long periods of time. In many cases, a minimum of three operators are required to assemble/disassemble the scaffolding and the operators often must have specific skills and requisites according to national safety standards.

For example, International Pat. Publ. No. WO/2011/107573 to Ferrari describes a modular scaffolding structure comprising a plurality of collapsible parallel quadrangular platforms inter-connected by a plurality of struts comprising a first, lower end provided with first means of mobile coupling with a first corresponding platform, and a second, upper end provided with second means of mobile coupling with a second corresponding platform positioned adjoiningly above said first platform. The first means of mobile coupling allow the rotation of said struts around a hinge point and the second means of mobile coupling allow said second end of said struts to slide with respect to said second corresponding platform. The struts are movable between a first position in which they lie interposed between said first and second platform, and a second position in which they extend substantially perpendicular to said platforms. The structure also comprises first and second blocking means for blocking said first and second means of mobile coupling.

U.S. Pat. No. 4,452,337 to Atzinger describes a vertical hoisting pole or mast that is furnished with vertically-spaced clamp members located adjacent the lower end of the mast for coupling the mast to both an intermediate upright on an end frame of the scaffolding as well as to vertically-spaced rungs on the end frame. A pulley assembly is suspended from the top of the mast, and it includes a long rope acting with the pulley. One end of the rope is fitted with a loop that is adapted to be lowered over a top corner pin of the end frame. This loop carries an elongated push rod that has a hook formed on the free end thereof. This push rod may be used for lifting the loop off of the corner pin so as to easily disconnect the rope from the end frame, and the hook end of the push rod may serve for lifting the platform or deck from one level of scaffold to another.

U.S. Patent Publ. No. US20150184402 to Gardner describes a scaffold system adapted for securing to a structure and for vertical movement relative to the structure. The scaffold system includes first and second wall mounts, each of the wall mounts having a bar and at least one spring biasing the bar in a first direction, a slide post having a slide hook, a slide arm and a hanging pad secured to the slide arm, the slide post arranged for vertical axial movement within at least one of the first and second wall mounts, a main post having at least one post hook, a first deck fixedly secured to the main post, and a ball screw jack having a mounting plate and a lifting screw, the mounting plate secured to the first deck and the lifting screw secured to the hanging pad. The main post is arranged to complimentarily fit within slide post, the slide hook is adapted for releasable engagement with the first wall mount bar or the second wall mount bar and the at least one post hook is adapted for releasable engagement with the first wall mount bar or the second wall mount bar.

However, the conventional scaffold structures are scaffold designs fail to provide a segmented and integrated solution for scaffold extensions.

SUMMARY

In various example embodiments shown and described herein, an apparatus and method for manufacturing and using segmented and integrated solutions for scaffold extensions are disclosed. In an example embodiment, a standard scaffold support component can be manufactured with an integrated one-sided or an integrated two-sided extension arm. In other example embodiments, a standard scaffold support component can be retrofit with a retrofit scaffold support component, mountable on the standard scaffold support component, wherein the retrofit scaffold support component can include an integrated one-sided or an integrated two-sided extension arm. In other example embodiments, a standard scaffold support component can be manufactured or retrofit with an integrated one-sided extension arm with a hinged and swingable coupling or an integrated two-sided extension arm with hinged and swingable couplings. In other example embodiments, a standard scaffold support component can be manufactured or retrofit with an integrated one-sided extension arm with a removable coupling or an integrated two-sided extension arm with removable couplings. In other example embodiments, a standard scaffold support component can be manufactured or retrofit with an integrated one-sided extension arm with a top-mounted coupling or an integrated two-sided extension arm with top-mounted couplings.

An objective of the various example embodiments described herein is to provide a means of manufacturing and using scaffolding components so that they are more versatile, configurable, segmented and integrated, and easier and quicker to manufacture. In various example embodiments, a segmented and integrated scaffolding solution provides a variety of versatile and configurable components. Another objective of the various example embodiments described herein is to provide a means of manufacturing and using scaffolding components with integrated or retrofit extension arms that can serve a variety of purposes including platform or walkway support, lifting apparatus support, scaffold support, building anchors, and the like. Another objective of the various example embodiments described herein is to provide a means of manufacturing and using scaffold extension components that can be coupled to existing scaffold systems and designs.

Other features and advantages of the example embodiments will become apparent from the following detailed description taken in conjunction with the accompanying drawings which illustrate, by way of example, the principles of the example embodiments.

BRIEF DESCRIPTION OF THE DRAWINGS

For a better understanding of the example embodiments, reference should be made to the following detailed description disclosed in conjunction with the accompanying drawings, in which.

DETAILED DESCRIPTION

Reference will now be made in detail to the example embodiments illustrated in the accompanying drawings. Wherever possible, the same reference numbers will be used throughout the drawings to refer to the same or like parts. An apparatus and method for manufacturing and using segmented and integrated solutions for scaffold extensions are disclosed herein.

Figure 1:
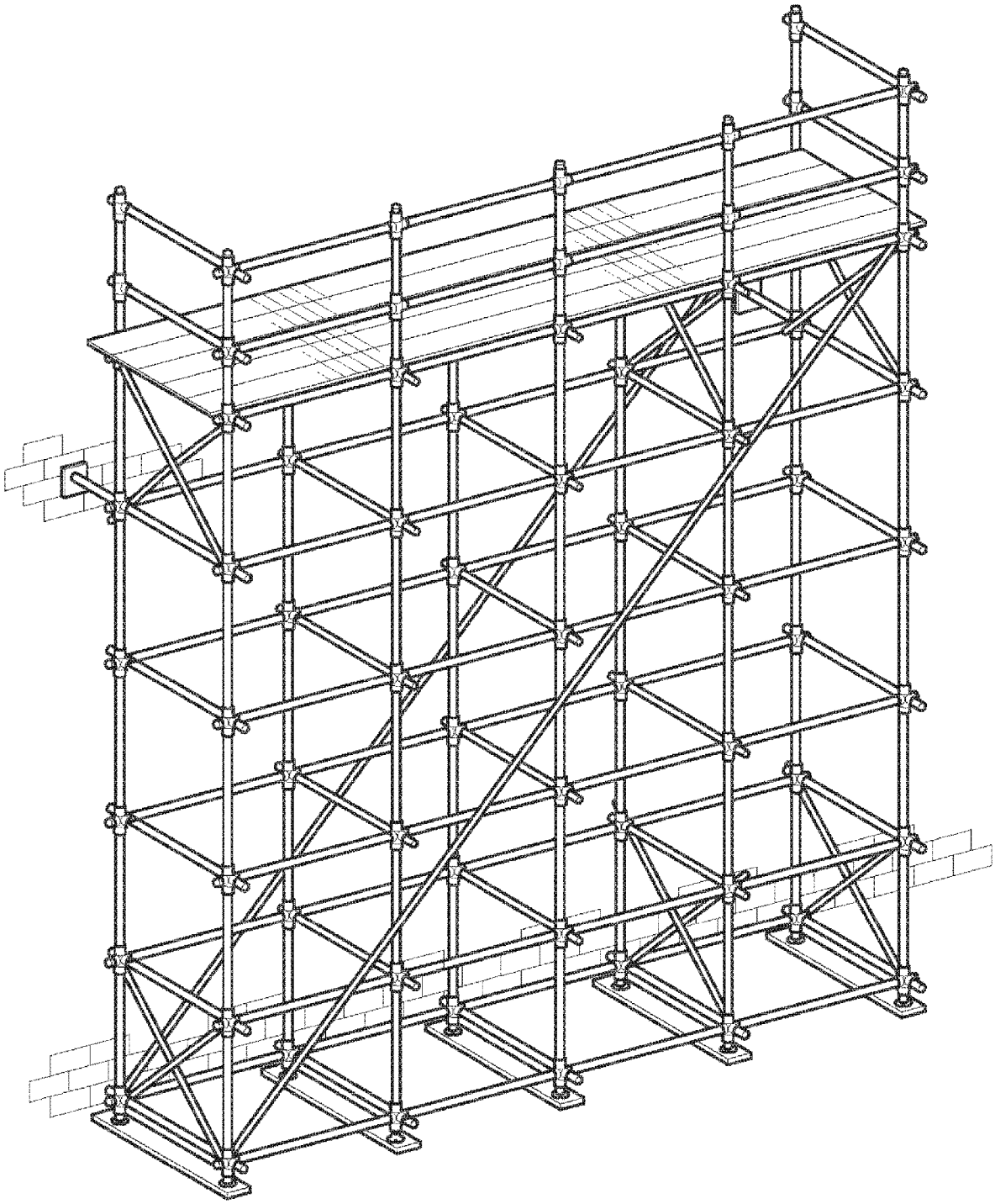
FIG. 1 (Prior Art)
FIGS. 1 and 2 are diagrams illustrating conventional scaffold designs from the existing technology.
Figure 2:
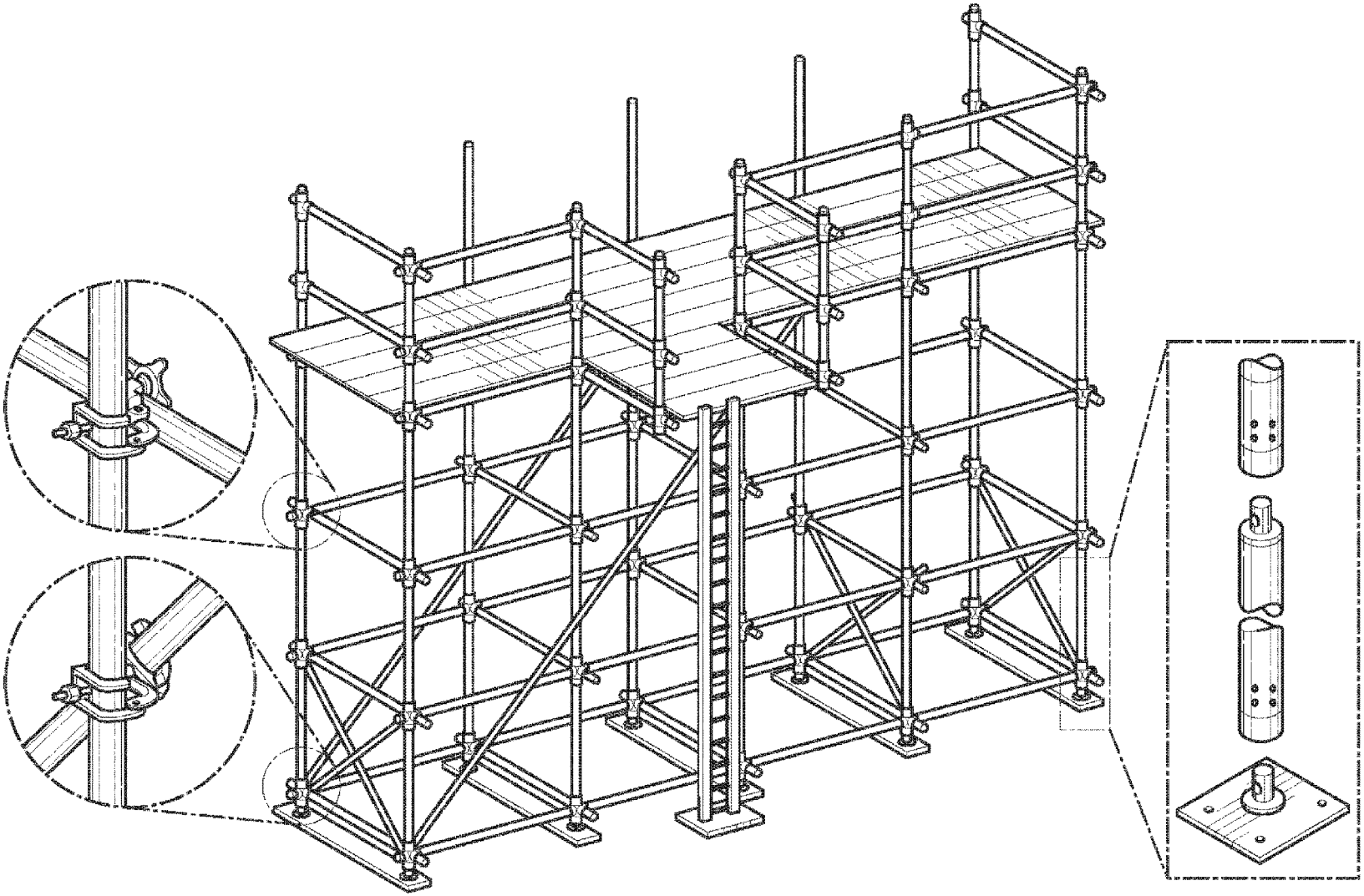
FIG. 2 (Prior Art)

FIGS. 1 and 2 are diagrams illustrating conventional scaffold designs from the existing technology. In general as shown in FIG. 1, the conventional scaffold designs include standard sectional scaffold components formed mainly of tubular steel and having standard scaffold support components with post, bearer, and runner elements that are held together by cross braces and diagonal braces. This particular type of standard scaffold can be configured with a sill at the bottom and planking and a guardrail at the top to enable a platform for workers. These standard scaffolds are adapted to be stacked vertically, one standard scaffold support component upon another, in multiple levels for gaining access to hard-to-reach places.

FIG. 2 illustrates another conventional scaffold design from the existing technology. As shown in FIG. 2, a tube and coupler scaffold design provides clamps and joint connections with which a plurality of standard scaffold support components can be connected together, both horizontally and vertically, to erect a completed scaffold structure in a desired configuration. Note, however, that the completed scaffold structure is limited by the design of the individual standard scaffold support components.

Figure 3:
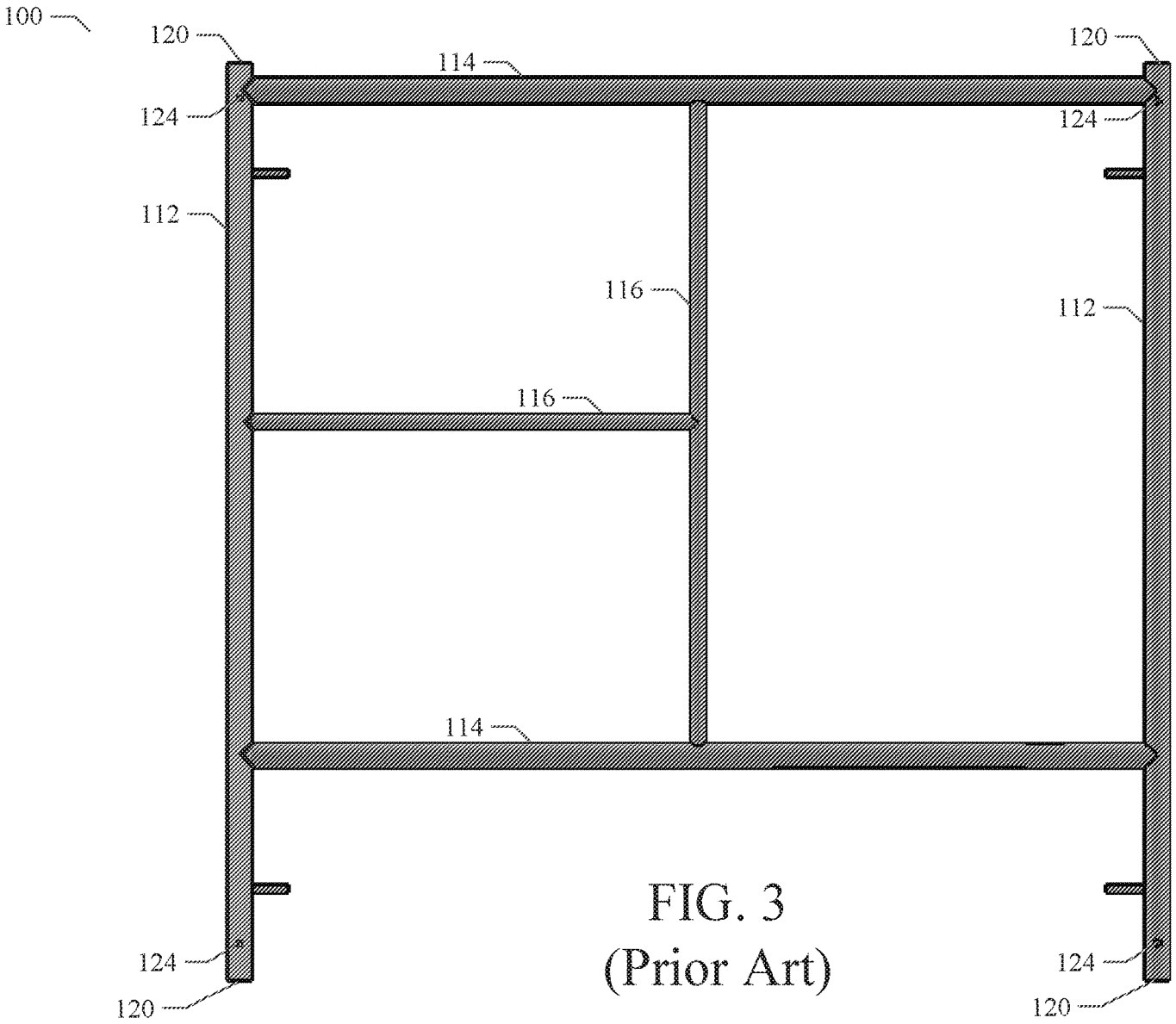
FIG. 3 (Prior Art)
FIG. 3 is a diagram illustrating a standard scaffold support component from a conventional scaffold design from the existing technology.

FIG. 3 is a diagram illustrating a standard scaffold support component 100 from a conventional scaffold design from the existing technology. As well-known, the standard scaffold support component 100, formed mainly of tubular steel, includes post 112 elements, runner 114 elements, and bracing 116 elements. The standard scaffold support component 100 also includes coupling joints 120, which can be used to join together two standard scaffold support components 100. In a typical configuration, the upper coupling joints 120 of a first standard scaffold support component 100 can be configured to slide into the lower coupling joints 120 of a second standard scaffold support component 100, or vice versa. The first standard scaffold support component 100 can be secured to the second standard scaffold support component 100 with pins inserted into the attachment holes 124 in the post 112 elements. As well-known to those of ordinary skill in the art, other means may be similarly used to connect and secure two standard scaffold support components 100. In this manner, a plurality of standard scaffold support component 100 can be connected together to erect a completed scaffold structure.

Figure 5:
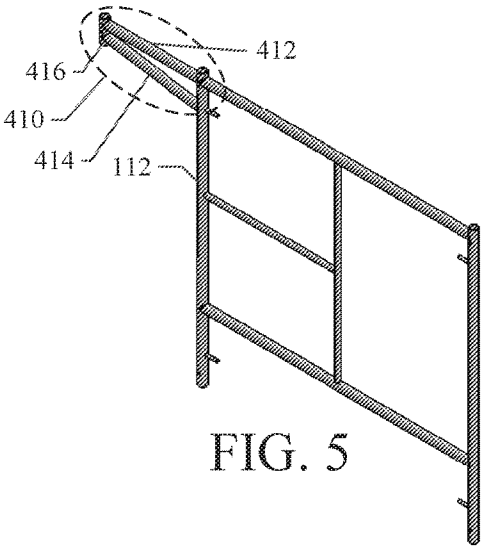
FIGS. 4 through 5 are diagrams illustrating a modified scaffold support component highlighting the integration of a one-sided scaffold extension according to an embodiment disclosed herein.
Figure 4:
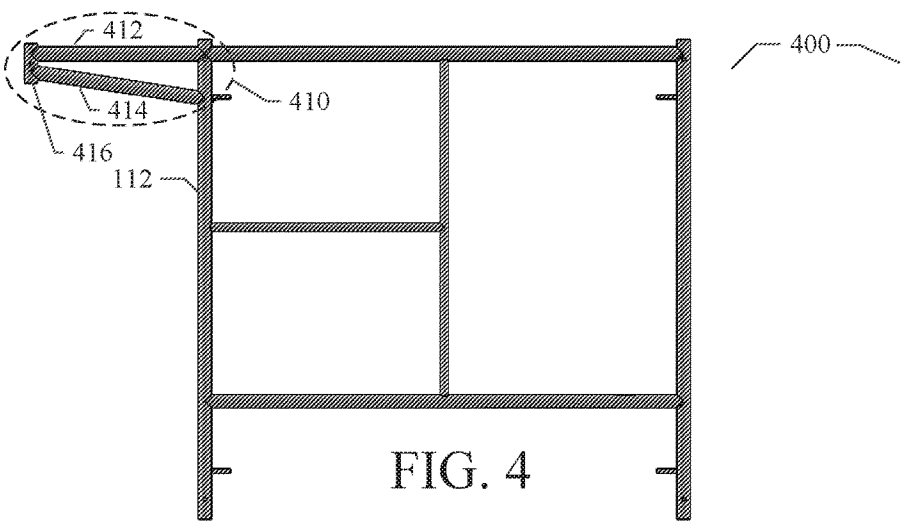

FIGS. 4 through 5 are diagrams illustrating a modified scaffold support component 400 highlighting the integration of a one-sided scaffold extension 410 according to an embodiment disclosed herein. As shown in FIGS. 4 through 5, the one-sided scaffold extension 410 can include a runner element 412 and a bracing element 414 joined at an outboard coupling joint 416. The inboard ends of the runner element 412 and the bracing element 414 can be integrated into one of the post 112 elements of the modified scaffold support component 400. The integration of the one-sided scaffold extension 410 into the post 112 element of the modified scaffold support component 400 can be done by welding, machining, or otherwise permanently joining the one-sided scaffold extension 410 into the post 112 element of the modified scaffold support component 400. The outboard coupling joint 416 of the one-sided scaffold extension 410 can be configured to serve a variety of purposes. For example, the outboard coupling joint 416 can be configured with a receiver coupling joint to receive a post element from a different scaffold support component. In other applications, the outboard coupling joint 416 can be configured to retain a support component to support a handrail, a walkway, a tools or materials platform, a pulley assembly, a lifting apparatus assembly, a building anchor, or the like. The scaffold extension 410 can be integrated with the modified scaffold support component 400 at the top end of the modified scaffold support component 400 as shown in FIGS. 4 and 5. Alternatively, the scaffold extension 410 can be integrated with the modified scaffold support component 400 at a midpoint of the post 112 element or at the lower end of the modified scaffold support component 400. In various applications, the scaffold extension 410 can serve to retain various support components as described above. In other applications, the scaffold extension 410 can serve as a building set-off to achieve a desired separation between the scaffold assembly and an adjacent structure. In other applications, the scaffold extension 410, integrated at the lower end of the modified scaffold support component 400, can serve as a brace or anchor in contact with the ground to prevent lateral movement or tilting of the scaffold structure.

Figure 7:
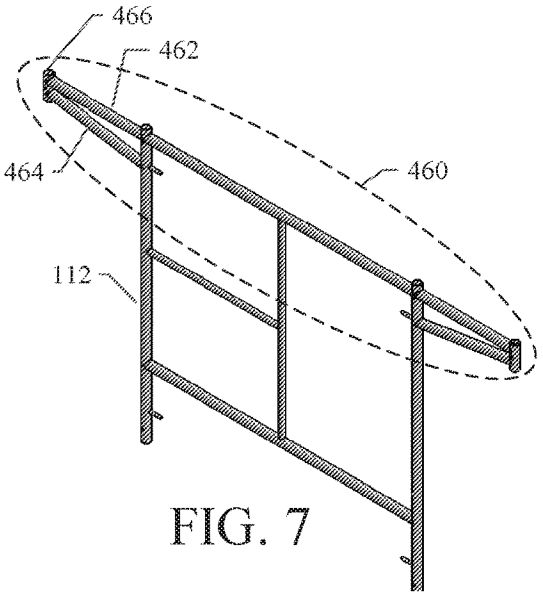
FIGS. 6 through 7 are diagrams illustrating a modified scaffold support component highlighting the integration of a two-sided scaffold extension according to an embodiment disclosed herein.
Figure 6:
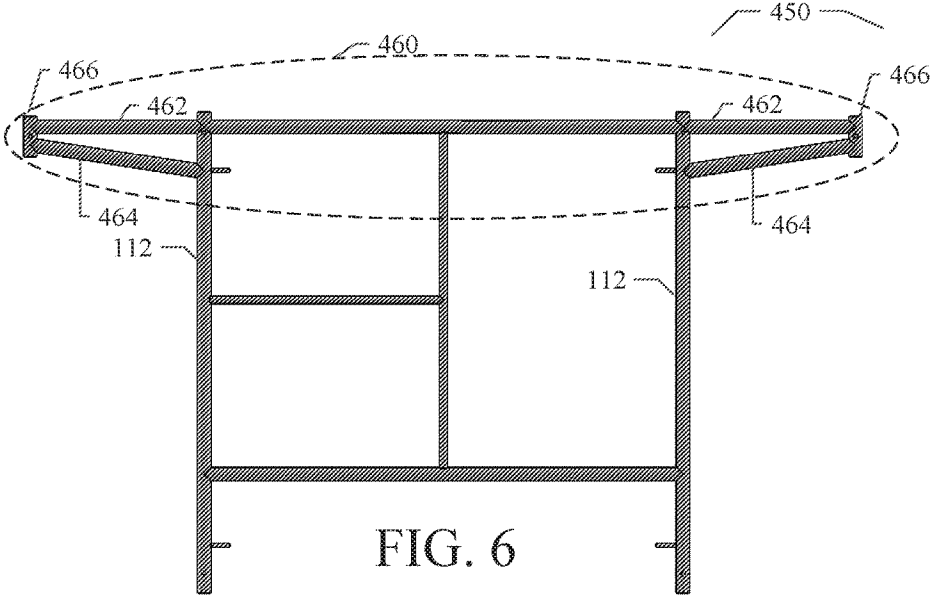

FIGS. 6 through 7 are diagrams illustrating a modified scaffold support component 450 highlighting the integration of a two-sided scaffold extension 460 according to an embodiment disclosed herein. As shown in FIGS. 6 through 7, the two-sided scaffold extension 460 can include runner elements 462 and bracing elements 464 joined at outboard coupling joints 466. The inboard ends of the runner elements 462 and the bracing elements 464 can be integrated into the post 112 elements of the modified scaffold support component 450. The integration of the two-sided scaffold extension 460 into the post 112 elements of the modified scaffold support component 450 can be done by welding, machining, or otherwise permanently joining the two-sided scaffold extension 460 into the post 112 elements of the modified scaffold support component 450. The outboard coupling joints 466 of the two-sided scaffold extension 410 can be configured to serve a variety of purposes as described above.

The scaffold extension 460 can be integrated with the modified scaffold support component 450 at the top end of the modified scaffold support component 450 as shown in FIGS. 6 and 7. Alternatively, the scaffold extension 460 can be integrated with the modified scaffold support component 450 at a midpoint of the post 112 element or at the lower end of the modified scaffold support component 450. In various applications, the scaffold extension 460 can serve to retain various support components as described above. In other applications, the scaffold extension 460 can serve as a building set-off to achieve a desired separation between the scaffold assembly and an adjacent structure. In other applications, the scaffold extension 460, integrated at the lower end of the modified scaffold support component 450, can serve as a brace or anchor in contact with the ground to prevent lateral movement or tilting of the scaffold structure.

Figure 9:
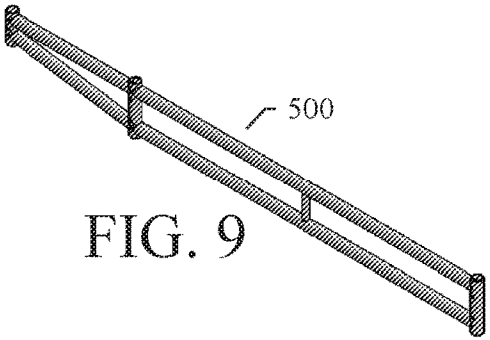
FIGS. 8 through 9 are diagrams illustrating a retrofit scaffold support component, mountable on a standard scaffold support component, highlighting the integration of a one-sided scaffold extension according to an embodiment disclosed herein.
Figure 8:
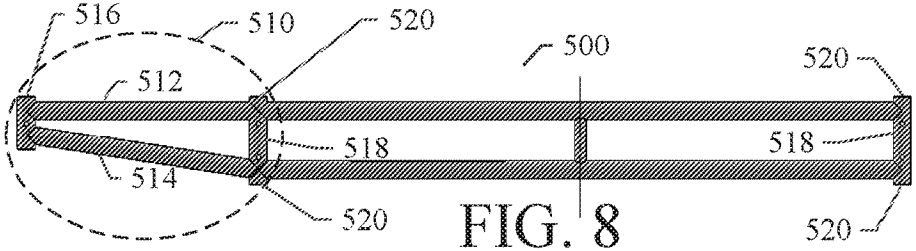

FIGS. 8 through 9 are diagrams illustrating a retrofit scaffold support component 500, mountable on a standard scaffold support component 100, highlighting the integration of a one-sided scaffold extension 510 according to an embodiment disclosed herein. As shown in FIGS. 8 through 9, the one-sided scaffold extension 510 can include a runner element 512 and a bracing element 514 joined at an outboard coupling joint 516. The inboard ends of the runner element 512 and the bracing element 514 can be integrated into a shortened post 518 element of the retrofit scaffold support component 500. The integration of the one-sided scaffold extension 510 into the shortened post 518 element of the retrofit scaffold support component 500 can be done by welding, machining, or otherwise permanently joining the one-sided scaffold extension 510 into the shortened post 518 element of the retrofit scaffold support component 500. The outboard coupling joint 516 of the one-sided scaffold extension 510 can be configured to serve a variety of purposes as described above.

Figure 12:
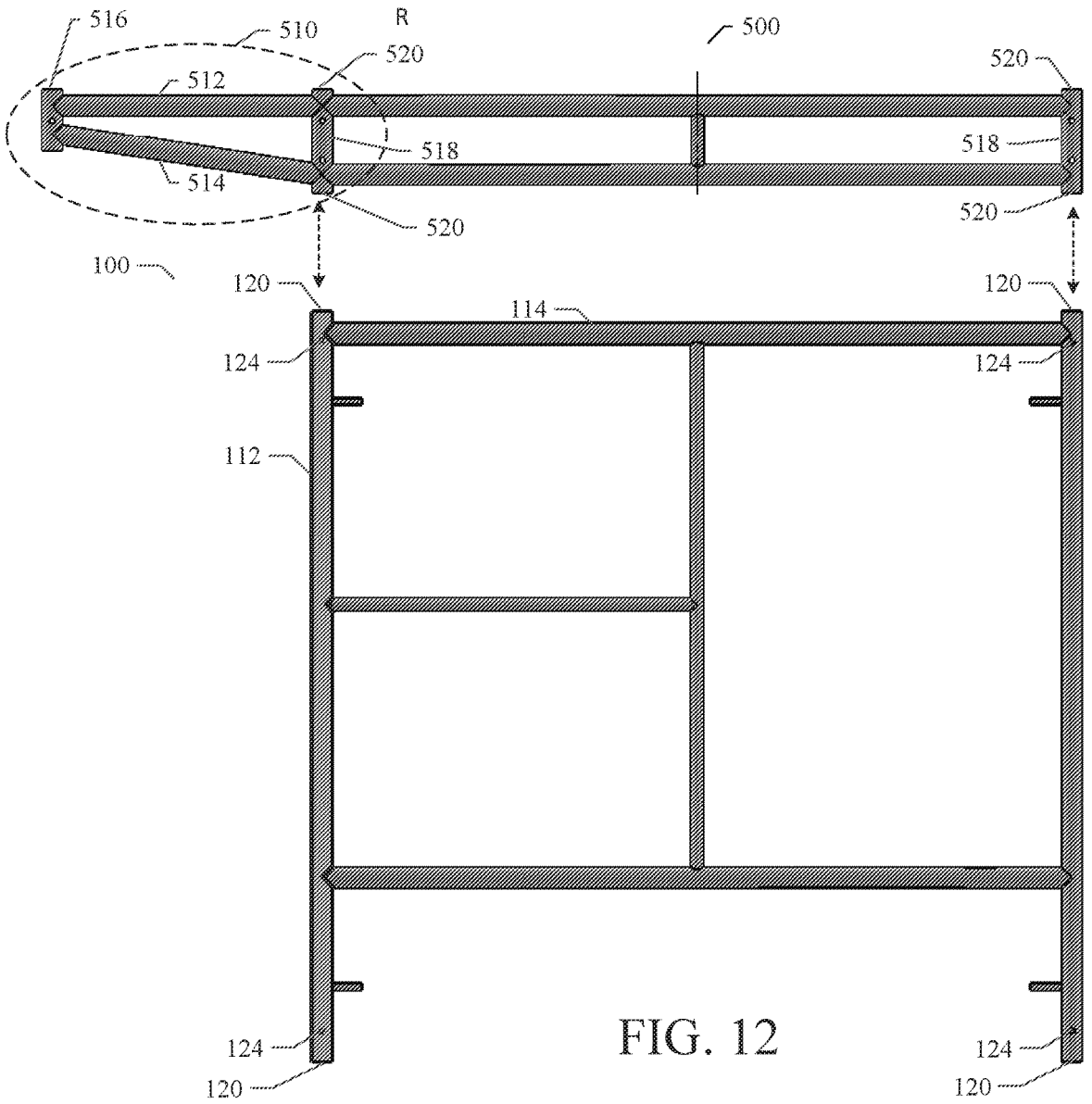
FIG. 12 is a diagram illustrating how a retrofit scaffold support component with a one-sided scaffold extension can be mounted on a standard scaffold support component according to an embodiment disclosed herein.

The retrofit scaffold support component 500 of an example embodiment is configured to be mountable on a standard scaffold support component 100 as shown in FIG. 12. The retrofit scaffold support component 500 is configured to include coupling joints 520 at both ends of the shortened post 518 element. These coupling joints 520 are configured to slide over or into the coupling joints 120 of the standard scaffold support component 100. As a result, the retrofit scaffold support component 500 can be joined to a standard scaffold support component 100 and locked into place with pins inserted into attachment holes 124 in the post 112 elements. In this manner, the retrofit scaffold support component 500 can enable the inclusion of a one-sided scaffold extension in a scaffold assembly without requiring specially manufactured standard scaffold support components 100. This enables the use of the scaffold extension as disclosed herein with a variety of existing scaffold structures.

Figure 11:
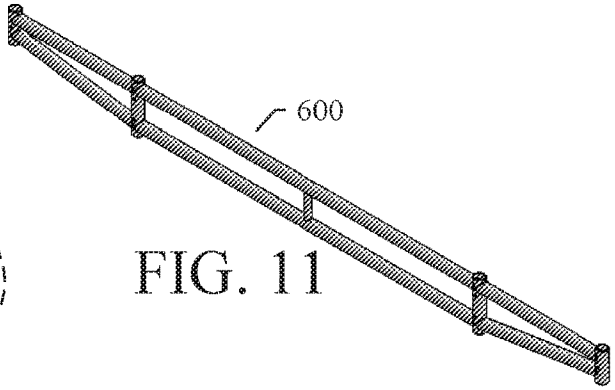
FIGS. 10 through 11 are diagrams illustrating a retrofit scaffold support component, mountable on a standard scaffold support component, highlighting the integration of a two-sided scaffold extension according to an embodiment disclosed herein.
Figure 10:
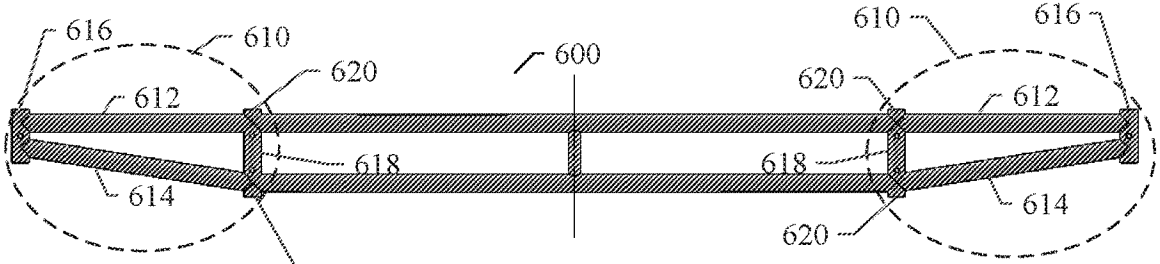

FIGS. 10 through 11 are diagrams illustrating a retrofit scaffold support component 600, mountable on a standard scaffold support component 100, highlighting the integration of a two-sided scaffold extension 610 according to an embodiment disclosed herein. As shown in FIGS. 10 through 11, the two-sided scaffold extension 610 can include a runner element 612 and a bracing element 614 joined at an outboard coupling joint 616. The inboard ends of the runner element 612 and the bracing element 614 can be integrated into a shortened post 618 element of the retrofit scaffold support component 600. The integration of the two-sided scaffold extension 610 into the shortened post 618 element of the retrofit scaffold support component 600 can be done by welding, machining, or otherwise permanently joining the two-sided scaffold extension 610 into the shortened post 618 element of the retrofit scaffold support component 600. The outboard coupling joint 616 of the two-sided scaffold extension 510 can be configured to serve a variety of purposes as described above.

Figure 13:
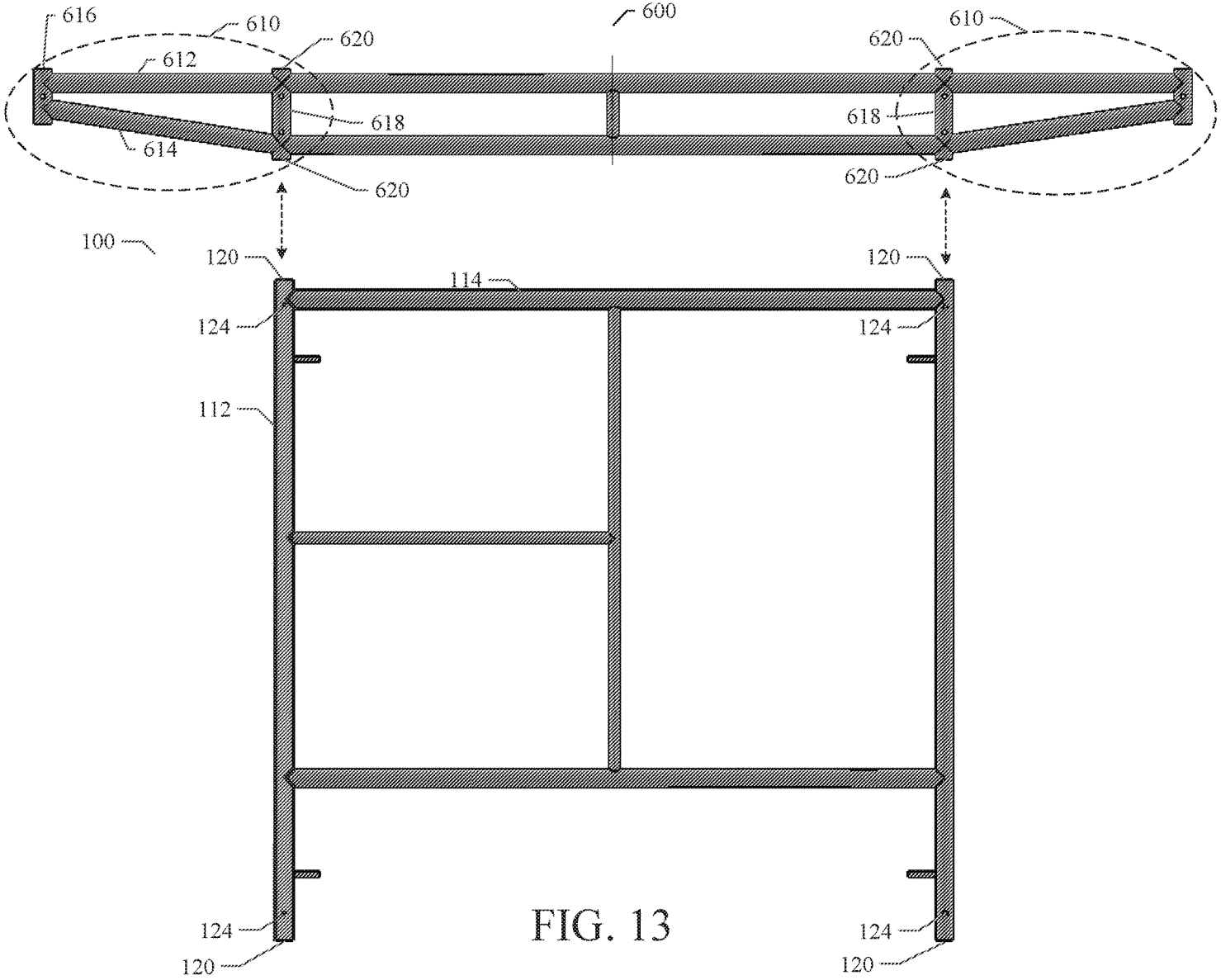
FIG. 13 is a diagram illustrating how a retrofit scaffold support component with a two-sided scaffold extension can be mounted on a standard scaffold support component according to an embodiment disclosed herein.

The retrofit scaffold support component 600 of an example embodiment is configured to be mountable on a standard scaffold support component 100 as shown in FIG. 13. The retrofit scaffold support component 600 is configured to include coupling joints 620 at both ends of the shortened post 618 element. These coupling joints 620 are configured to slide over or into the coupling joints 120 of the standard scaffold support component 100. As a result, the retrofit scaffold support component 600 can be joined to a standard scaffold support component 100 and locked into place with pins inserted into attachment holes 124 in the post 112 elements. In this manner, the retrofit scaffold support component 600 can enable the inclusion of a two-sided scaffold extension in a scaffold assembly without requiring specially manufactured standard scaffold support components 100. This enables the use of the scaffold extension as disclosed herein with a variety of existing scaffold structures.

FIG. 12 is a diagram illustrating how a retrofit scaffold support component 500 with a one-sided scaffold extension 510 can be mounted on a standard scaffold support component 100 according to an embodiment disclosed herein. As described above, the retrofit scaffold support component 500 can be joined to a standard scaffold support component 100 and locked into place with pins inserted into attachment holes 124 in the post 112 elements. In this manner, the retrofit scaffold support component 500 can enable the inclusion of a one-sided scaffold extension in a conventional scaffold assembly.

FIG. 13 is a diagram illustrating how a retrofit scaffold support component 600 with a two-sided scaffold extension 610 can be mounted on a standard scaffold support component 100 according to an embodiment disclosed herein. As described above, the retrofit scaffold support component 600 can be joined to a standard scaffold support component 100 and locked into place with pins inserted into attachment holes 124 in the post 112 elements. In this manner, the retrofit scaffold support component 600 can enable the inclusion of a two-sided scaffold extension in a conventional scaffold assembly.

Figure 14:
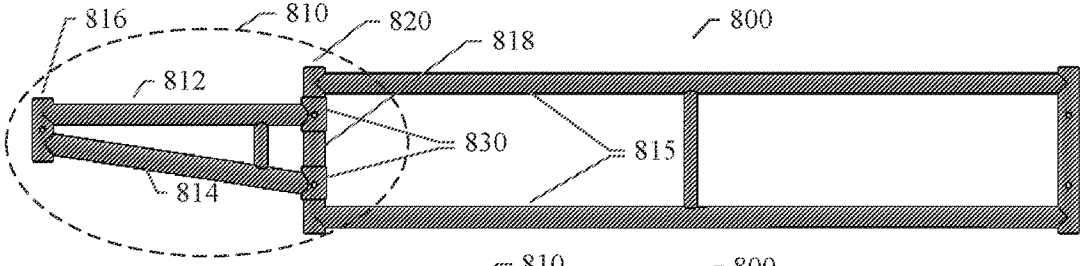
FIGS. 14 through 15 are diagrams illustrating a retrofit scaffold support component, mountable on a standard scaffold support component, highlighting the coupling of a one-sided scaffold extension with a hinged and swingable coupling according to an embodiment disclosed herein.
Figure 15:
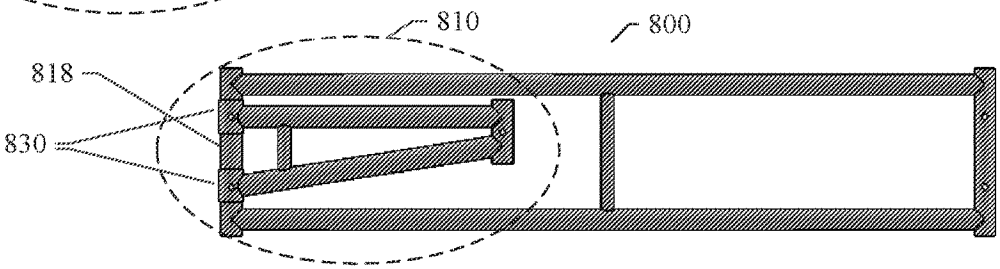

FIGS. 14 through 15 are diagrams illustrating a retrofit scaffold support component 800, mountable on a standard scaffold support component 100, highlighting the coupling of a one-sided scaffold extension 810 with a hinged and swingable coupling 830 according to an embodiment disclosed herein. As shown in FIGS. 14 through 15, the one-sided scaffold extension 810 can include a runner element 812 and a bracing element 814 joined at an outboard coupling joint 816. The inboard ends of the runner element 812 and the bracing element 814 can be coupled to a shortened post 818 with a hinged and swingable coupling 830. The hinged coupling 830 can be implemented as a cylindrical component configured to wrap around all or a portion of the shortened post 818. The hinged coupling 830 enables the one-sided scaffold extension 810 to swing horizontally, pivoting around the shortened post 818. The hinged coupling 830 can be captured between runners 815 of the retrofit scaffold support component 800. As shown in FIGS. 14 through 15, the one-sided scaffold extension 810 can swing a full 360 degrees around the shortened post 818. The outboard coupling joint 816 of the one-sided scaffold extension 810 can be configured to serve a variety of purposes as described above.

The retrofit scaffold support component 800 of an example embodiment is configured to be mountable on a standard scaffold support component 100, similar to the embodiment shown in FIG. 12. The retrofit scaffold support component 800 is configured to include coupling joints 820 at both ends of the shortened post 818 element. These coupling joints 820 are configured to slide over or into the coupling joints 120 of the standard scaffold support component 100. As a result, the retrofit scaffold support component 800 can be joined to a standard scaffold support component 100 and locked into place with pins inserted into attachment holes 124 in the post 112 elements. In this manner, the retrofit scaffold support component 800 can enable the inclusion of a one-sided scaffold extension with a hinged and swingable coupling in a scaffold assembly without requiring specially manufactured standard scaffold support components 100. This enables the use of the scaffold extension as disclosed herein with a variety of existing scaffold structures.

Figure 17:
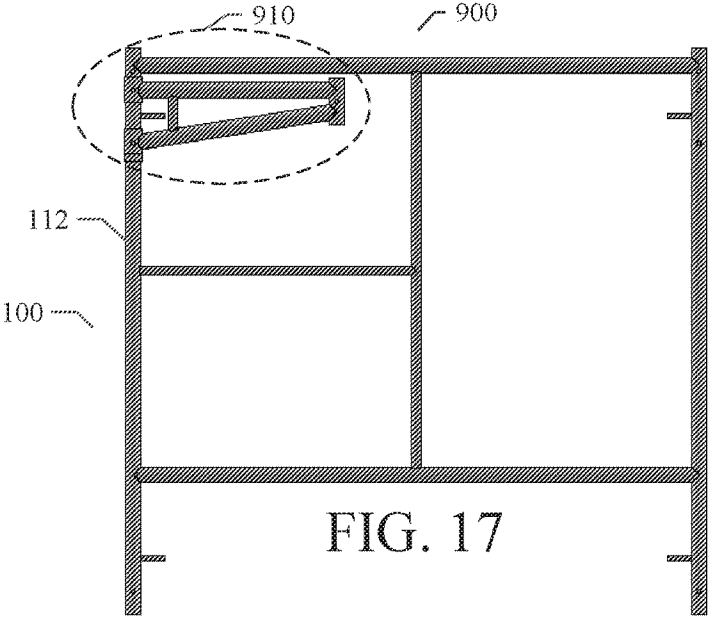
FIGS. 16 through 17 are diagrams illustrating a modified scaffold support component highlighting the coupling of a one-sided scaffold extension with a hinged and swingable coupling according to an embodiment disclosed herein.
Figure 16:
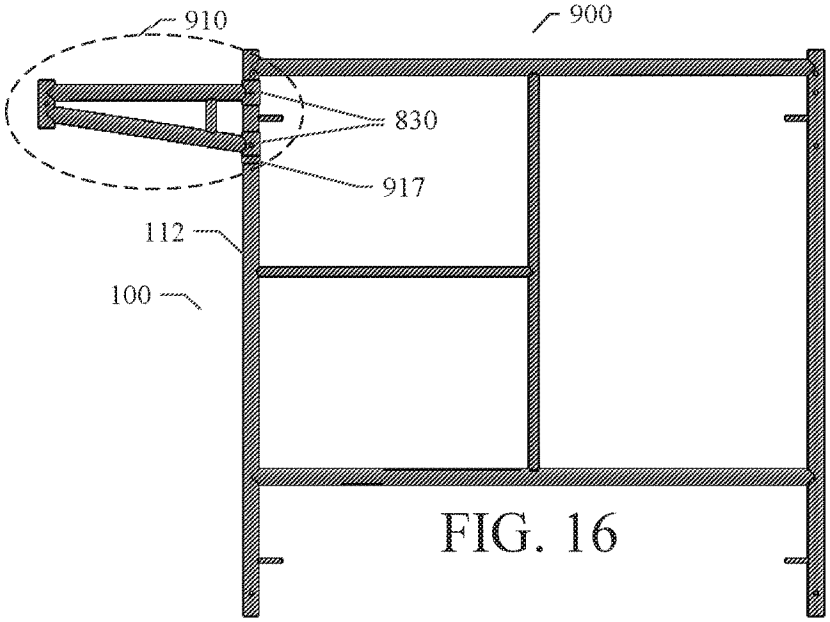

FIGS. 16 through 17 are diagrams illustrating a modified scaffold support component 900 highlighting the coupling of a one-sided scaffold extension 910 with a hinged and swingable coupling 830 according to an embodiment disclosed herein. In this embodiment, the one-sided scaffold extension 910 can be coupled directly to a post 112 element of the standard scaffold support component 100. As described above and shown in FIGS. 16 through 17, the hinged and swingable coupling 830 enables the one-sided scaffold extension 910 to swing a full 360 degrees around the post 112. The hinged coupling 830 of the modified scaffold support component 900 can be captured between an upper runner of the modified scaffold support component 900 and a stationary band 917 installed around the post 112 and below the lower hinged coupling 830 of scaffold extension 910. The embodiment of FIGS. 16 through 17 allow the retrofit of a standard scaffold support component 100 with a one-sided scaffold extension 910 with a hinged and swingable coupling.

Figure 18:
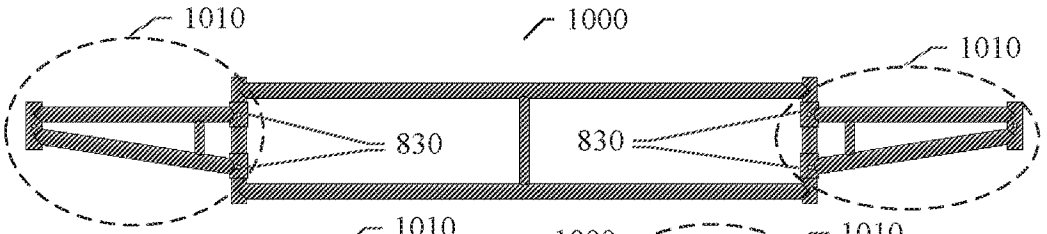
FIGS. 18 through 19 are diagrams illustrating a retrofit scaffold support component, mountable on a standard scaffold support component, highlighting the coupling of a two-sided scaffold extension with hinged and swingable couplings according to an embodiment disclosed herein.
Figure 19:
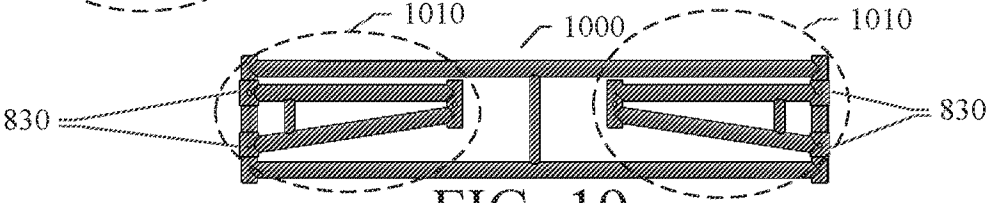

FIGS. 18 through 19 are diagrams illustrating a retrofit scaffold support component 1000, mountable on a standard scaffold support component 100, highlighting the coupling of a two-sided scaffold extension 1010 with hinged and swingable couplings 830 according to an embodiment disclosed herein. As shown in FIGS. 18 through 19, the two-sided scaffold extension 1010 can include runner elements and bracing elements joined at outboard coupling joints as described above. The inboard ends of the runner elements and bracing elements can be coupled to shortened posts with hinged and swingable couplings 830. The hinged couplings 830 can be implemented as cylindrical components configured to wrap around all or a portion of the shortened posts. The hinged couplings 830 enable the two-sided scaffold extension 1010 to swing horizontally, pivoting around the shortened posts. The hinged couplings 830 can be captured between runners of the retrofit scaffold support component 1000. As shown in FIGS. 18 through 19, the two-sided scaffold extension 1010 can swing a full 360 degrees around the shortened posts.

The retrofit scaffold support component 1000 of an example embodiment is configured to be mountable on a standard scaffold support component 100, similar to the embodiment shown in FIG. 13. The retrofit scaffold support component 1000 is configured to include coupling joints at both ends of the shortened post elements as described above. These coupling joints are configured to slide over or into the coupling joints 120 of the standard scaffold support component 100. As a result, the retrofit scaffold support component 1000 can be joined to a standard scaffold support component 100 and locked into place with pins inserted into attachment holes 124 in the post 112 elements. In this manner, the retrofit scaffold support component 1000 can enable the inclusion of a two-sided scaffold extension with a hinged and swingable coupling in a scaffold assembly without requiring specially manufactured standard scaffold support components 100. This enables the use of the scaffold extension as disclosed herein with a variety of existing scaffold structures.

Figure 21:
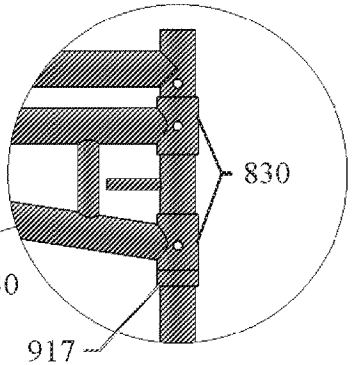
FIGS. 20 through 21 are diagrams illustrating a modified scaffold support component highlighting the coupling of a two-sided scaffold extension with hinged and swingable couplings according to an embodiment disclosed herein.
Figure 21:
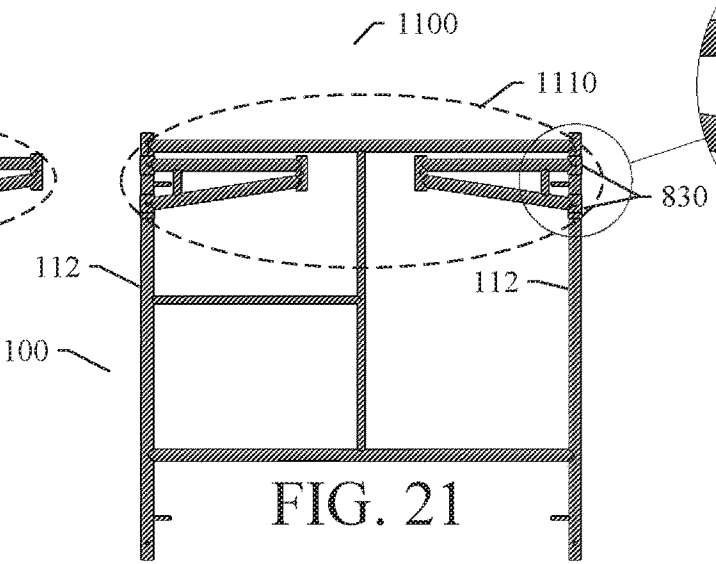
Figure 20:
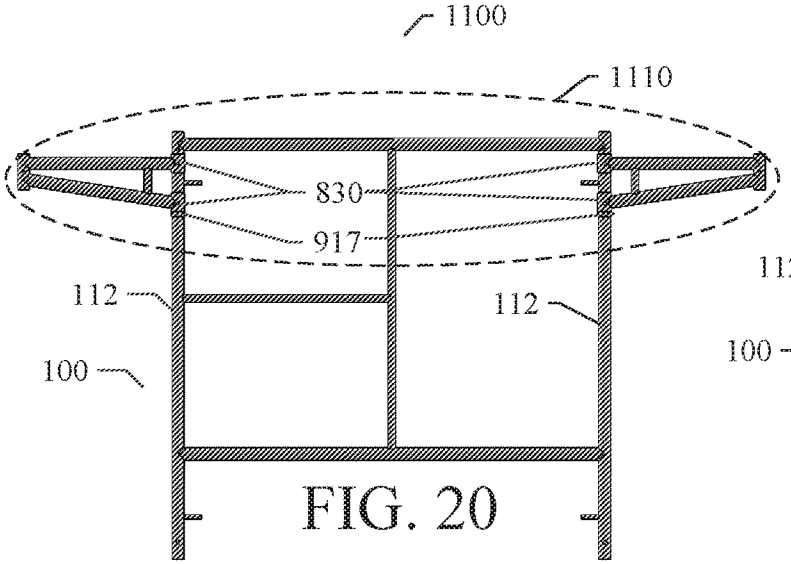
Figure 22:
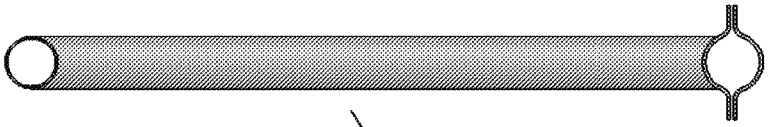
FIGS. 22 through 25 are diagrams illustrating details of a first alternative coupling structure for the one-sided or two-sided scaffold extension with a removable coupling according to an embodiment disclosed herein.
Figure 23:
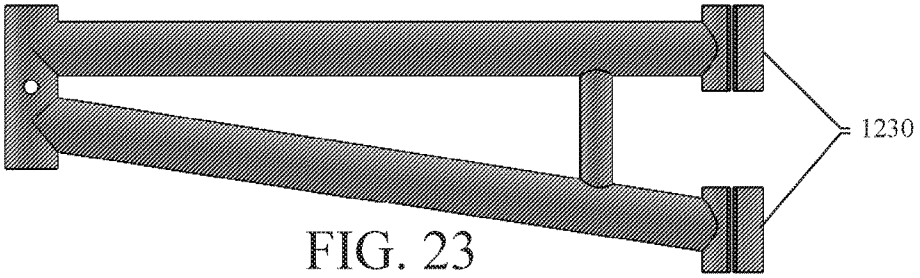
Figure 24:
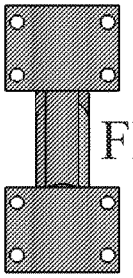
Figure 25:
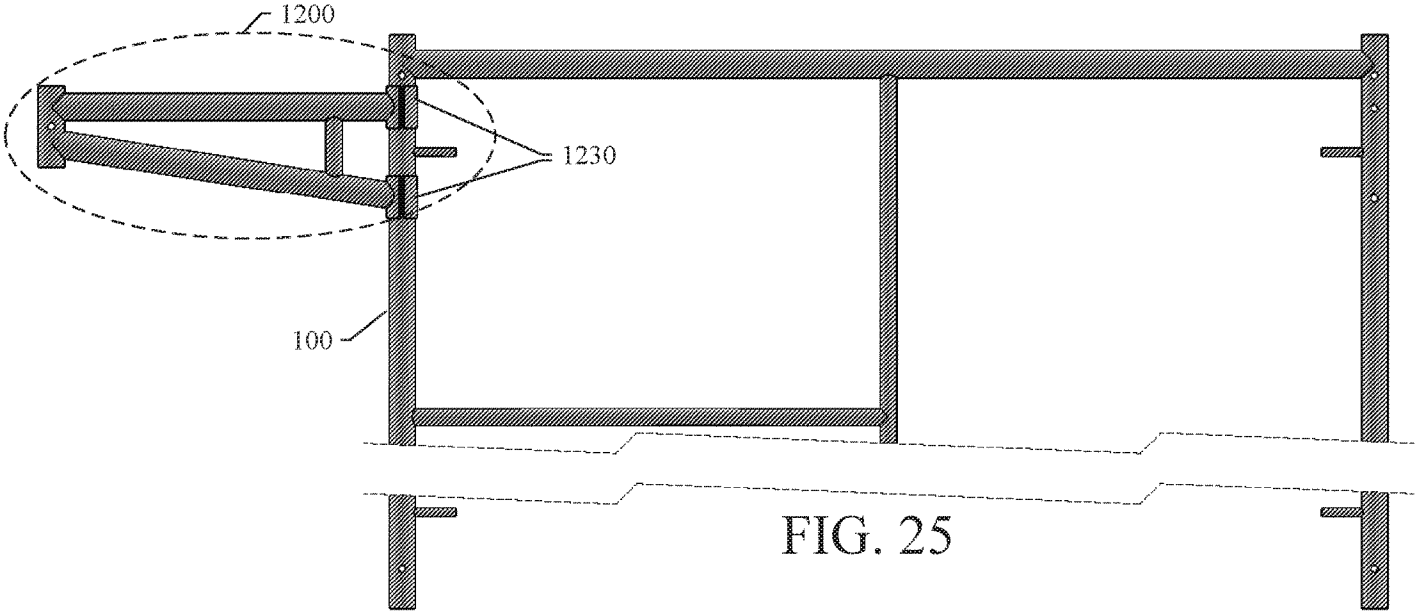
Figure 26:
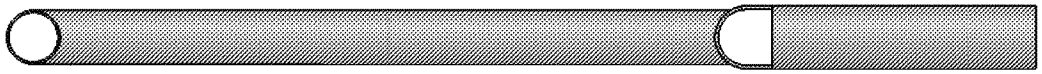
FIGS. 26 through 29 are diagrams illustrating details of a second alternative coupling structure for the one-sided or two-sided scaffold extension with a top-mounted coupling according to an embodiment disclosed herein.
Figure 28:
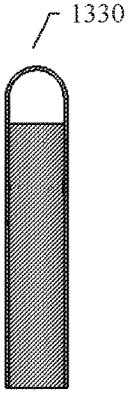
Figure 27:
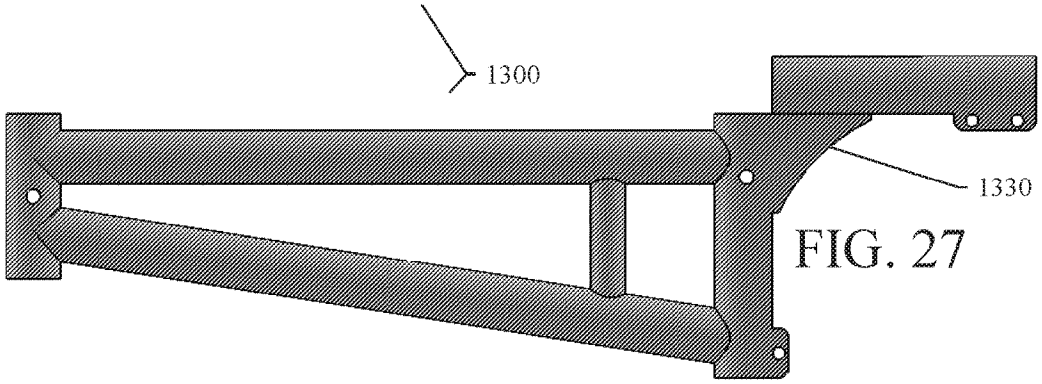
Figure 29:
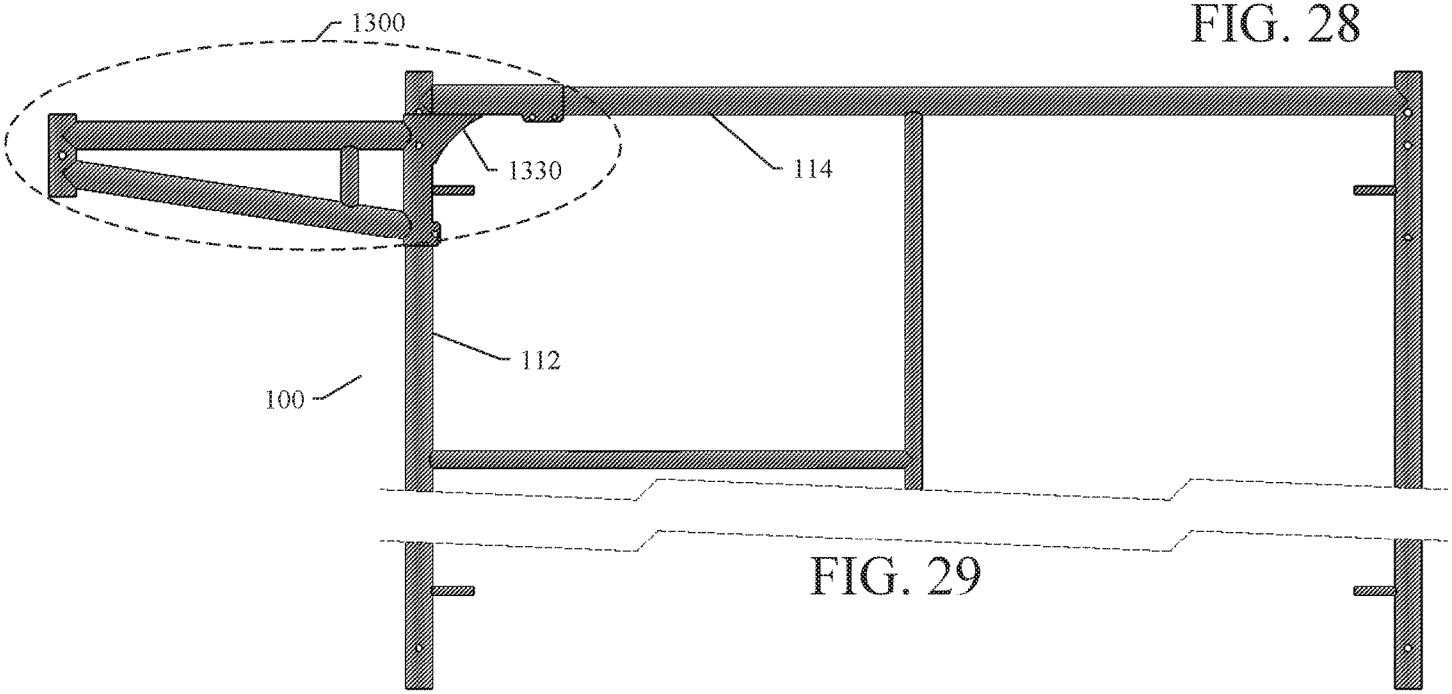

FIGS. 20 through 21 are diagrams illustrating the modified scaffold support component 1100 highlighting the coupling of a two-sided scaffold extension 1110 with hinged and swingable couplings 830 according to an embodiment disclosed herein. In this embodiment, the two-sided scaffold extension 1110 can be coupled directly to a post 112 element of the standard scaffold support component 100. As described above and shown in FIGS. 20 through 21, the hinged and swingable couplings 830 enable the two-sided scaffold extension 1110 to swing a full 360 degrees around the post 112. The hinged couplings 830 of the modified scaffold support component 1100 can be captured between an upper runner of the modified scaffold support component 1100 and stationary bands 917 installed around the post 112 and below the lower hinged couplings 830 of scaffold extension 1110. The embodiment of FIGS. 20 through 21 allow the retrofit of a standard scaffold support component 100 with a two-sided scaffold extension 1110 with hinged and swingable couplings.

FIGS. 22 through 25 are diagrams illustrating details of a first alternative coupling structure for the one-sided or two-sided scaffold extension 1200 with a removable coupling 1230 according to an embodiment disclosed herein. The removable coupling 1230 of an example embodiment can be fabricated as two components that can wrap a post 112 of a standard scaffold support component 100 and can be coupled together with bolts, screws, or pins to couple the one-sided or two-sided scaffold extension 1200 to a standard scaffold support component 100. The two-component coupling 1230 enables the easy attachment or removal of the one-sided or two-sided scaffold extension 1200 to a standard scaffold support component 100.

FIGS. 26 through 29 are diagrams illustrating details of a second alternative coupling structure for the one-sided or two-sided scaffold extension 1300 with a top-mounted coupling 1330 according to an embodiment disclosed herein. The top-mounted coupling 1330 of an example embodiment can be fabricated as one or multiple components configured to mount to the top of a runner 114 and to wrap a post 112 of a standard scaffold support component 100. The top-mounted coupling 1330 can be attached to the runner 114 and post 112 with bolts, screws, or pins to couple the one-sided or two-sided scaffold extension 1300 to a standard scaffold support component 100. The top-mounted coupling 1330 provides a stronger support structure for the scaffold extension 1300 and enables the easy attachment or removal of the one-sided or two-sided scaffold extension 1300 to a standard scaffold support component 100.

Figure 30:
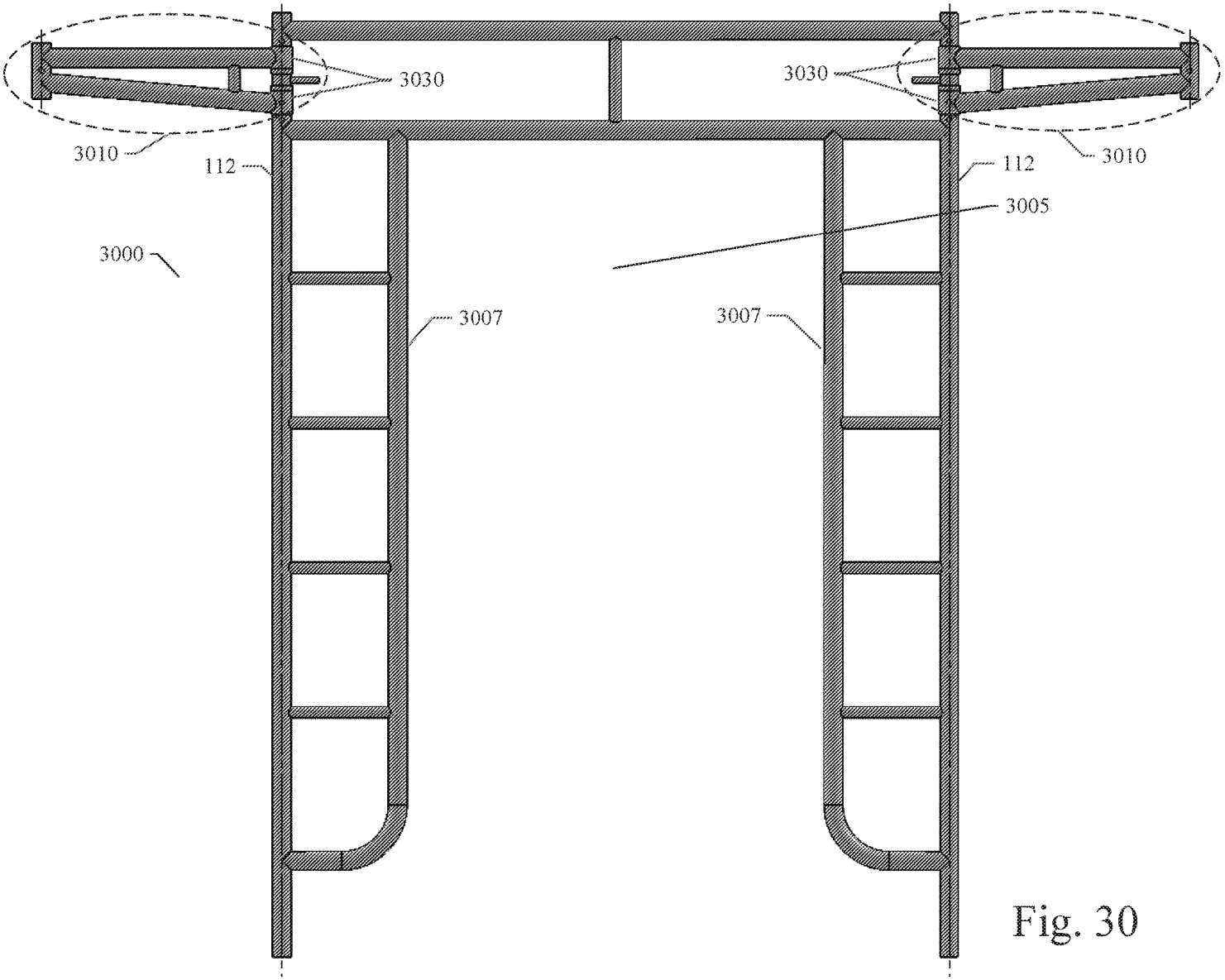
FIG. 30 illustrates a modified scaffold support component with a walk-through center portion having vertical support elements and highlighting the coupling of two-sided scaffold extensions with a hinged and swingable coupling according to an embodiment disclosed herein.

FIG. 30 illustrates a modified scaffold support component 3000 with a walk-through center portion 3005 having vertical support elements 3007 and highlighting the coupling of two-sided scaffold extensions 3010 with a hinged and swingable coupling 3030 according to an embodiment disclosed herein. In this embodiment, the two-sided scaffold extensions 3010 can be coupled directly to post 112 elements of the modified scaffold support component 3000. As described above, the hinged and swingable coupling 3030 enables the two-sided scaffold extensions 3010 to swing a full 360 degrees around the post 112. The hinged coupling 3030 of the modified scaffold support component 3000 can be captured between an upper runner and a lower runner of the modified scaffold support component 3000 and installed around the post 112. The modified scaffold support component 3000 can include vertical support elements 3007 configured as shown to provide structural support for the modified scaffold support component 3000 while also providing a gap or opening in the center of the modified scaffold support component 3000 to enable a walk-through center portion 3005. The example embodiment of FIG. 30 allows the removable installation of the hinged and swingable two-sided scaffold extensions 3010 while providing a walk-through modified scaffold support component 3000.

Figure 31:
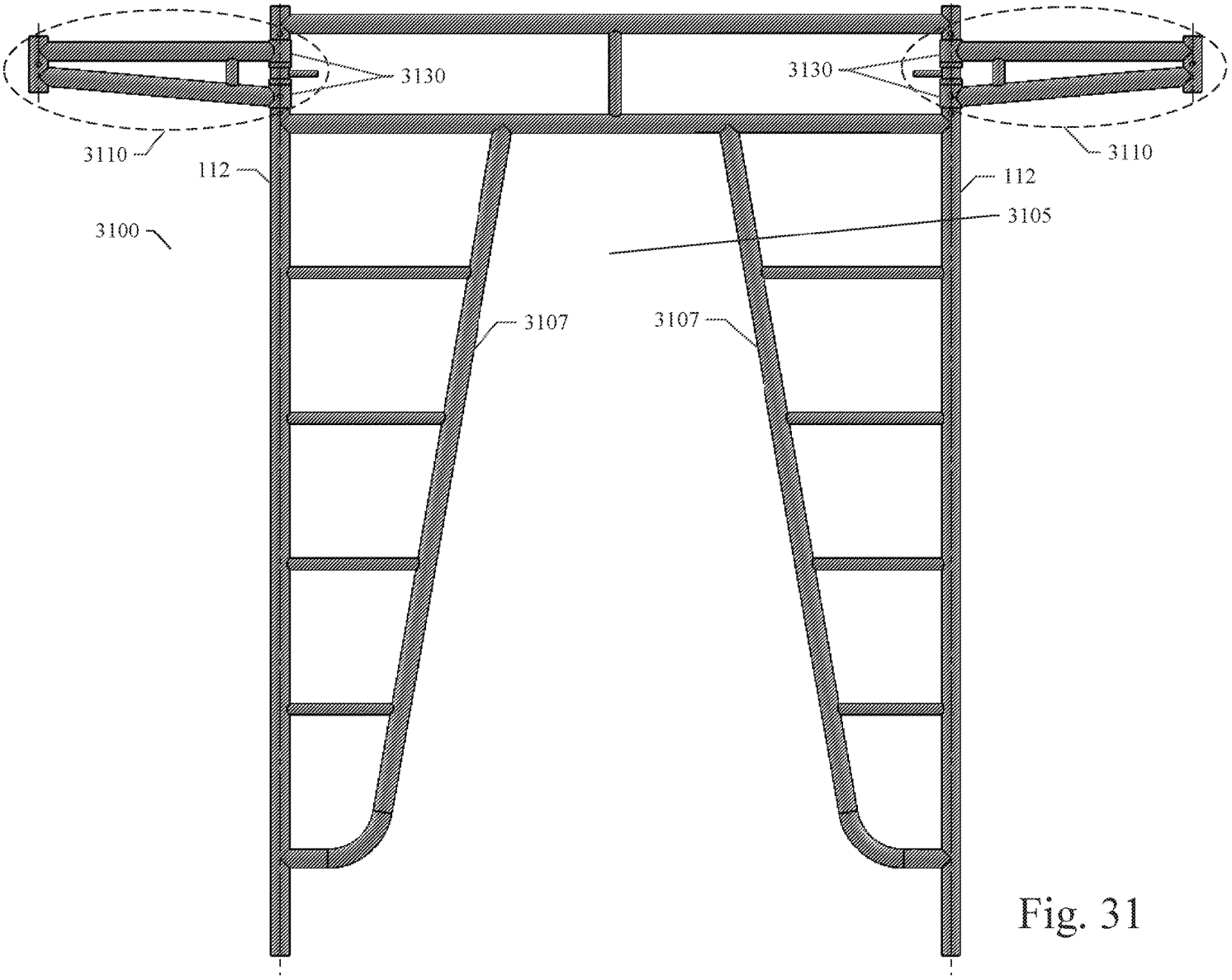
FIG. 31 illustrates a modified scaffold support component with a walk-through center portion having angled support elements and highlighting the coupling of two-sided scaffold extensions with a hinged and swingable coupling according to an embodiment disclosed herein.

FIG. 31 illustrates a modified scaffold support component 3100 with a walk-through center portion 3105 having angled support elements 3107 and highlighting the coupling of two-sided scaffold extensions 3110 with a hinged and swingable coupling 3130 according to an embodiment disclosed herein. In this embodiment, the two-sided scaffold extensions 3110 can be coupled directly to post 112 elements of the modified scaffold support component 3100. As described above, the hinged and swingable coupling 3130 enables the two-sided scaffold extensions 3110 to swing a full 360 degrees around the post 112. The hinged coupling 3130 of the modified scaffold support component 3100 can be captured between an upper runner and a lower runner of the modified scaffold support component 3100 and installed around the post 112. The modified scaffold support component 3100 can include angled support elements 3107 configured as shown to provide a high level of structural support for the modified scaffold support component 3100 while also providing a gap or opening in the center of the modified scaffold support component 3100 to enable a walk-through center portion 3105. The example embodiment of FIG. 31 allows the removable installation of the hinged and swingable two-sided scaffold extensions 3110 while providing a walk-through modified scaffold support component 3100 with a high level of structural and lateral support.

Figure 32:
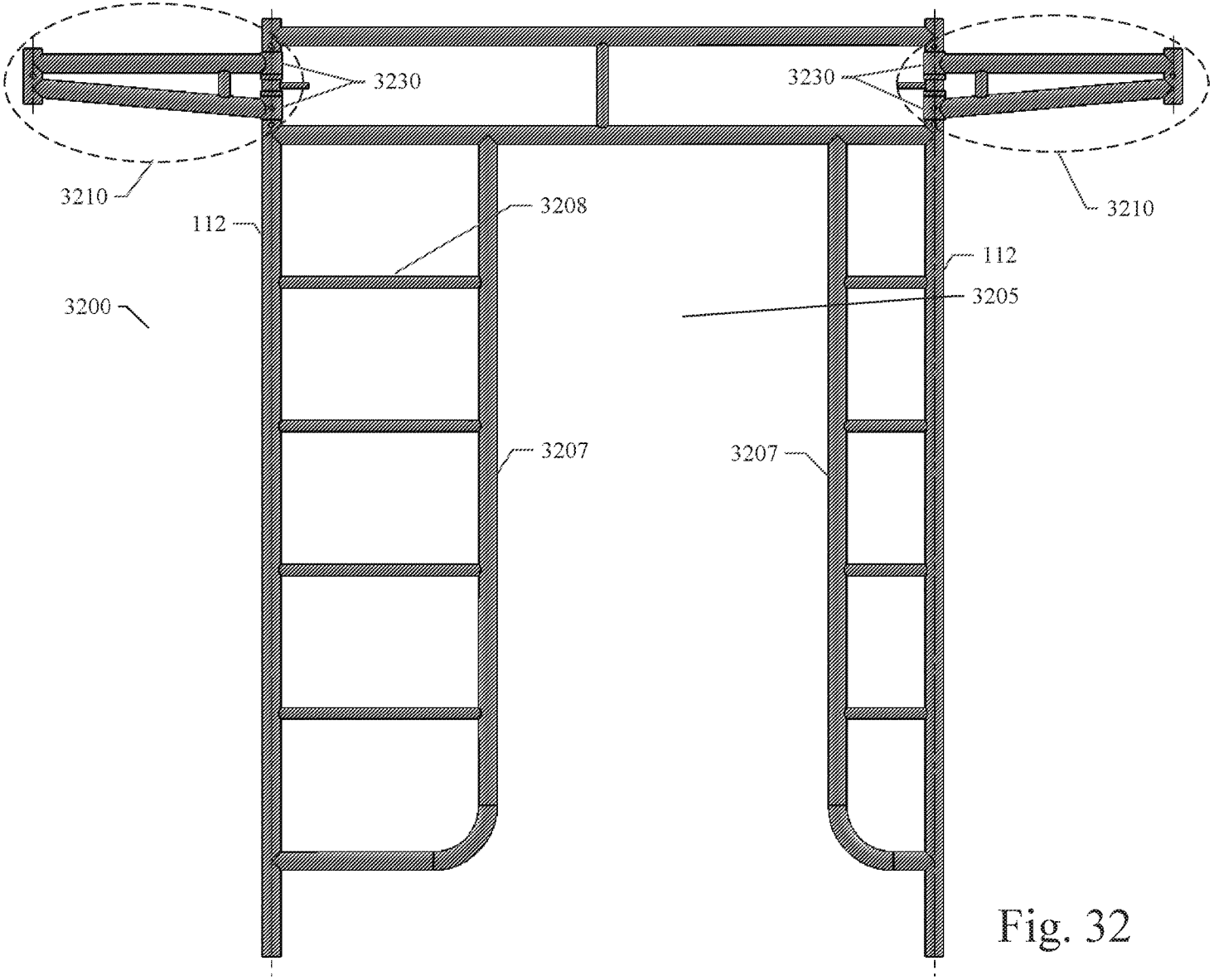
FIG. 32 illustrates a modified scaffold support component with a walk-through center portion with a ladder portion having vertical support elements and highlighting the coupling of two-sided scaffold extensions with a hinged and swingable coupling according to an embodiment disclosed herein.

FIG. 32 illustrates a modified scaffold support component 3200 with a walk-through center portion 3205 with a ladder portion 3208 having vertical support elements 3207 and highlighting the coupling of two-sided scaffold extensions 3210 with a hinged and swingable coupling 3230 according to an embodiment disclosed herein. In this embodiment, the two-sided scaffold extensions 3210 can be coupled directly to post 112 elements of the modified scaffold support component 3200. As described above, the hinged and swingable coupling 3230 enables the two-sided scaffold extensions 3210 to swing a full 360 degrees around the post 112. The hinged coupling 3230 of the modified scaffold support component 3200 can be captured between an upper runner and a lower runner of the modified scaffold support component 3200 and installed around the post 112. The modified scaffold support component 3200 can include vertical support elements 3207 configured as shown to provide structural support for the modified scaffold support component 3200 while also providing a gap or opening in the center of the modified scaffold support component 3200 to enable a walk-through center portion 3205. The modified scaffold support component 3200 can be configured as shown to include a ladder portion 3208 with horizontal rungs installed between the post 112 and one of the vertical support elements 3207. The example embodiment of FIG. 32 allows the removable installation of the hinged and swingable two-sided scaffold extensions 3210 while providing a walk-through modified scaffold support component 3200 with a ladder portion 3208.

Figure 33:
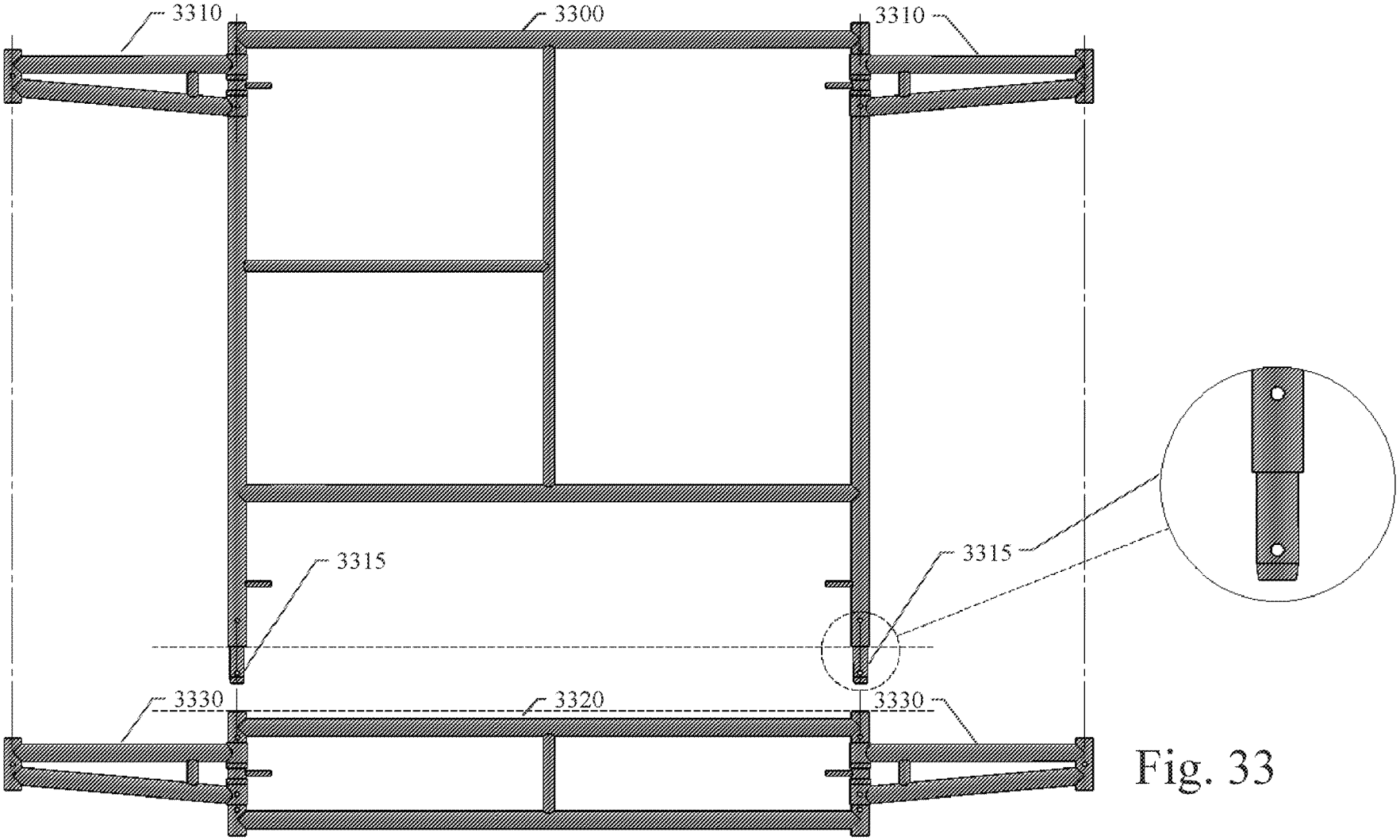
FIG. 33 illustrates a modified scaffold support component highlighting the coupling of a two-sided scaffold extension with hinged and swingable couplings and configured to mount on or couple with a retrofit scaffold support component, itself having a two-sided scaffold extension with hinged and swingable couplings for structural support and safety bracing according to an embodiment disclosed herein.

FIG. 33 illustrates a modified scaffold support component 3300 highlighting the coupling of a two-sided scaffold extension 3310 with hinged and swingable couplings and configured to mount on or couple with a retrofit scaffold support component 3320, itself having a two-sided scaffold extension 3330 with hinged and swingable couplings according to an embodiment disclosed herein. In the example embodiment of FIG. 33, the modified scaffold support component 3300 can be mounted on or coupled with the retrofit scaffold support component 3320 via scaffold mount couplings 3315 as shown in FIG. 33. As shown, the scaffold mount couplings 3315 can be configured with a reduced diameter post end that can be inserted into a receiving opening in an end of a post on the retrofit scaffold support component 3320. The post ends can be pinned together with holes provided therefor to securely, but removably, connect the modified scaffold support component 3300 with the retrofit scaffold support component 3320. As a result, the connected scaffold support components can provide two pairs of hinged and swingable scaffold extensions. Additionally, the retrofit scaffold support component 3320 can provide stabilizing bracing and safety bracing for the scaffold support component 3300. Moreover, the retrofit scaffold support component 3320 can serve as a support outrigger, a work platform, and a materials staging area.

Figure 34:
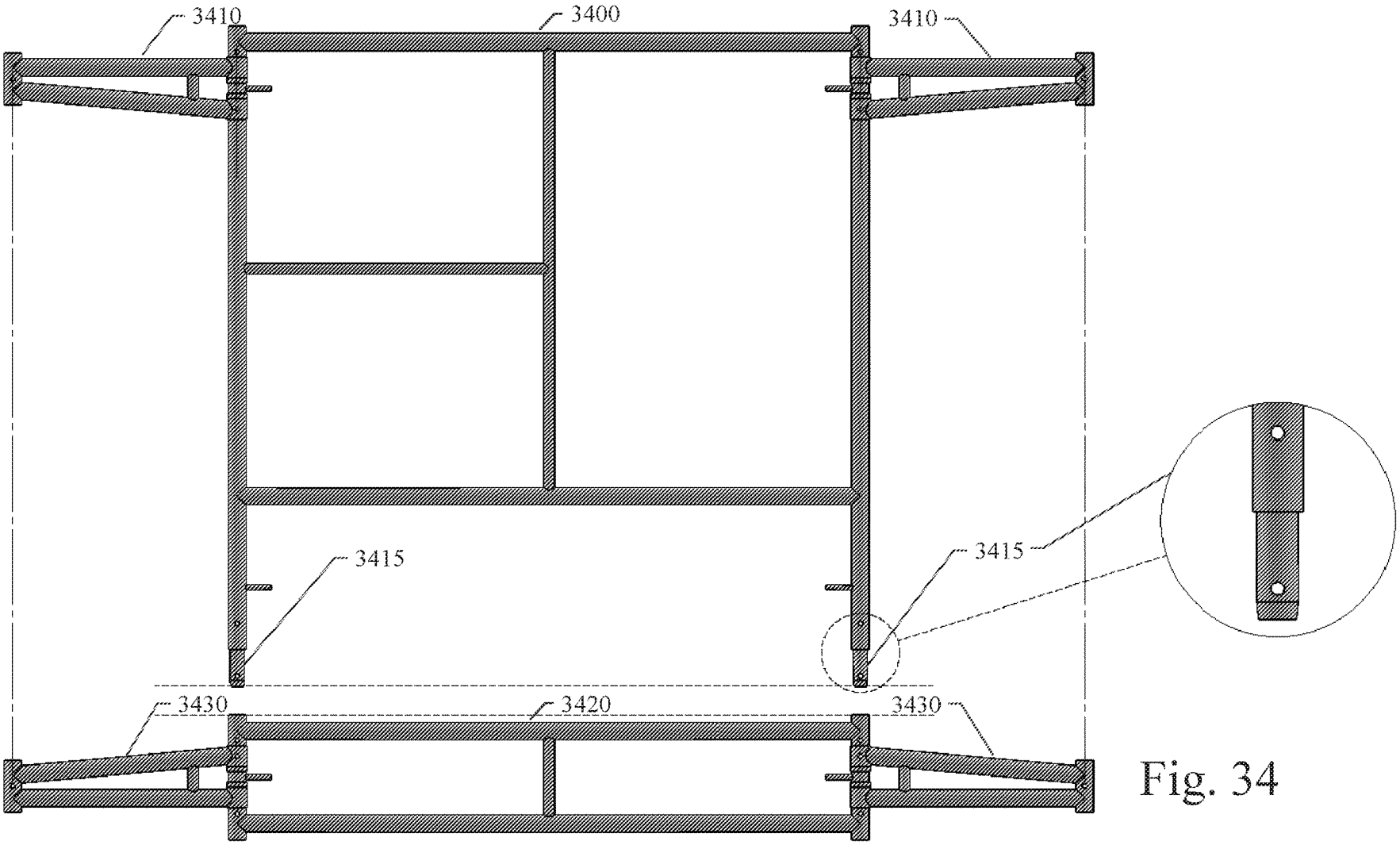
FIG. 34 illustrates a modified scaffold support component highlighting the coupling of a two-sided scaffold extension with hinged and swingable couplings and configured to mount on or couple with a retrofit scaffold base support component, itself having a two-sided scaffold extension with hinged and swingable couplings for structural support and safety bracing according to an embodiment disclosed herein.

FIG. 34 illustrates a modified scaffold support component 3400 highlighting the coupling of a two-sided scaffold extension 3410 with hinged and swingable couplings and configured to mount on or couple with a retrofit scaffold base support component 3420, itself having a two-sided scaffold extension 3430 with hinged and swingable couplings for base support according to an embodiment disclosed herein. In the example embodiment of FIG. 34, the modified scaffold support component 3400 can be mounted on or coupled with the retrofit scaffold base support component 3420 via scaffold mount couplings 3415 as shown in FIG. 34. As shown, the scaffold mount couplings 3415 can be configured with a reduced diameter post end that can be inserted into a receiving opening in an end of a post on the retrofit scaffold base support component 3420. The post ends can be pinned together with holes provided therefor to securely, but removably, connect the modified scaffold support component 3400 with the retrofit scaffold base support component 3420. As a result, the connected scaffold support components can provide two pairs of hinged and swingable scaffold extensions. The pair of hinged and swingable scaffold extensions 3430 on the retrofit scaffold base support component 3420 can be configured to rest on the ground or a support surface to provide stability for the connected modified scaffold support component 3400. Additionally, the retrofit scaffold base support component 3420 can provide stabilizing bracing and safety bracing for the scaffold support component 3400. Moreover, the retrofit scaffold base support component 3420 can serve as a support outrigger, a work platform, and a materials staging area.

Figure 35:
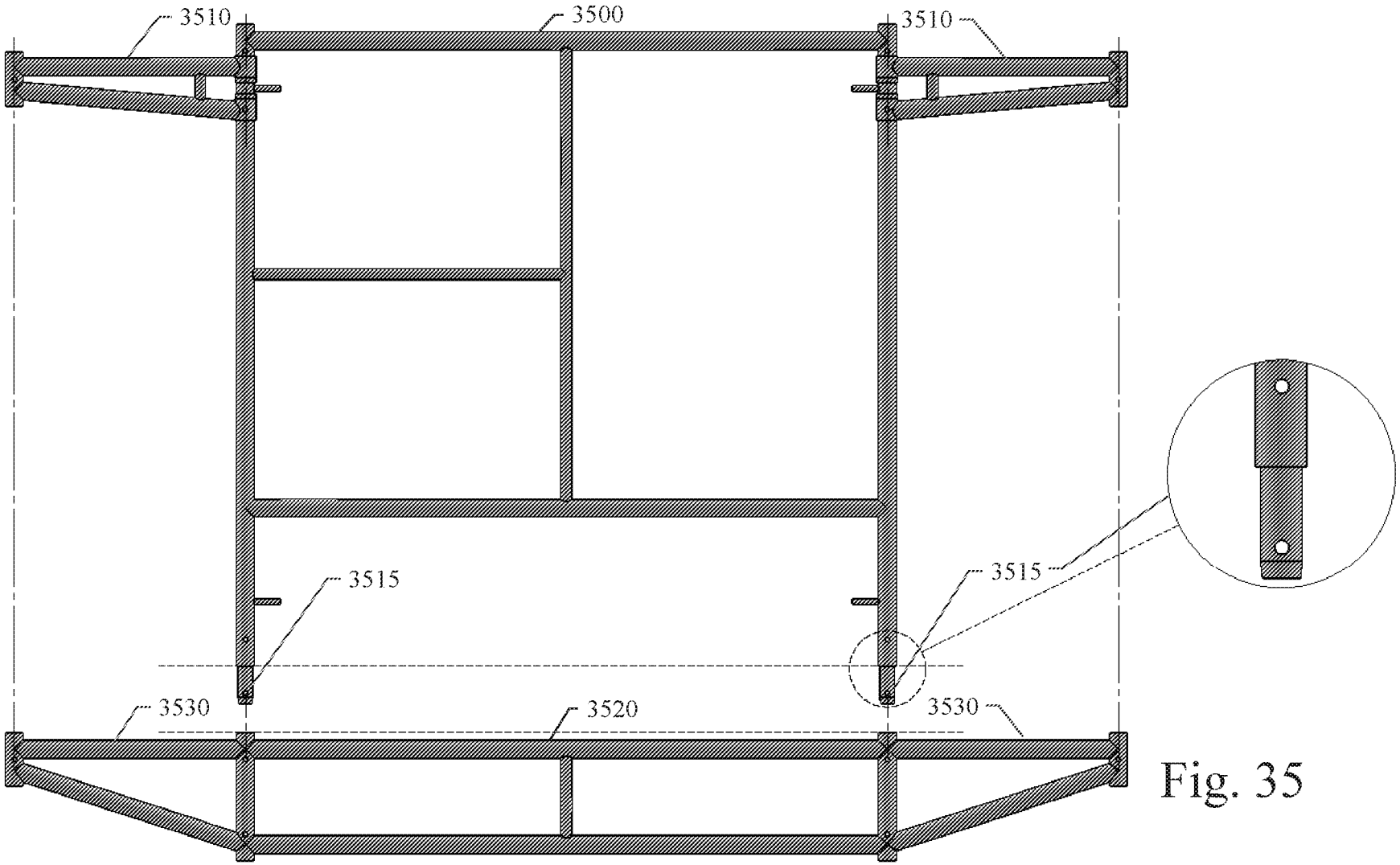
FIG. 35 illustrates a modified scaffold support component highlighting the coupling of a two-sided scaffold extension with hinged and swingable couplings and configured to mount on or couple with a retrofit scaffold support component, itself having a two-sided scaffold extension with fixed extensions for structural support and safety bracing according to an embodiment disclosed herein.

FIG. 35 illustrates a modified scaffold support component 3500 highlighting the coupling of a two-sided scaffold extension 3510 with hinged and swingable couplings and configured to mount on or couple with a retrofit scaffold support component 3520, itself having a two-sided scaffold extension 3530 with fixed extensions according to an embodiment disclosed herein. In the example embodiment of FIG. 35, the modified scaffold support component 3500 can be mounted on or coupled with the retrofit scaffold support component 3520 via scaffold mount couplings 3515 as shown in FIG. 35. As shown, the scaffold mount couplings 3515 can be configured with a reduced diameter post end that can be inserted into a receiving opening in an end of a post on the retrofit scaffold support component 3520. The post ends can be pinned together with holes provided therefor to securely, but removably, connect the modified scaffold support component 3500 with the retrofit scaffold support component 3520. As a result, the connected scaffold support components can provide two pairs of scaffold extensions, wherein one pair of scaffold extensions is a fixed extension and the other pair is a hinged and swingable extension. Additionally, the retrofit scaffold support component 3520 can provide stabilizing bracing and safety bracing for the scaffold support component 3500. Moreover, the retrofit scaffold support component 3520 can serve as a support outrigger, a work platform, and a materials staging area.

Figure 36:
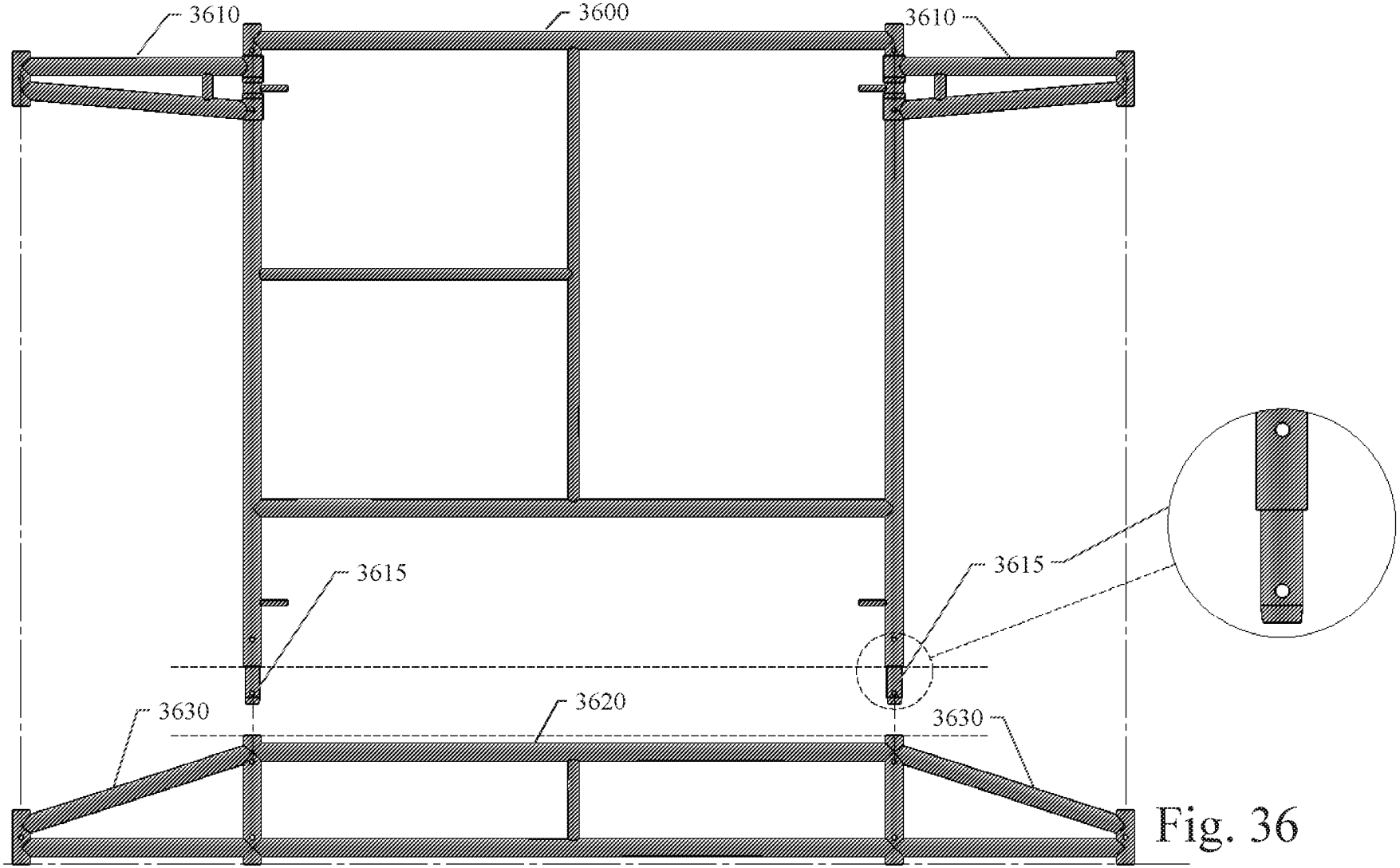
FIG. 36 illustrates a modified scaffold support component highlighting the coupling of a two-sided scaffold extension with hinged and swingable couplings and configured to mount on or couple with a retrofit scaffold base support component, itself having a two-sided scaffold extension with fixed extensions for structural support and safety bracing according to an embodiment disclosed herein.

FIG. 36 illustrates a modified scaffold support component 3600 highlighting the coupling of a two-sided scaffold extension 3610 with hinged and swingable couplings and configured to mount on or couple with a retrofit scaffold base support component 3620, itself having a two-sided scaffold extension 3630 with fixed base extensions for base support according to an embodiment disclosed herein. In the example embodiment of FIG. 36, the modified scaffold support component 3600 can be mounted on or coupled with the retrofit scaffold base support component 3620 via scaffold mount couplings 3615 as shown in FIG. 36. As shown, the scaffold mount couplings 3615 can be configured with a reduced diameter post end that can be inserted into a receiving opening in an end of a post on the retrofit scaffold base support component 3620. The post ends can be pinned together with holes provided therefor to securely, but removably, connect the modified scaffold support component 3600 with the retrofit scaffold base support component 3620. As a result, the connected scaffold support components can provide two pairs of scaffold extensions, wherein one pair of scaffold extensions is a fixed extension and the other pair is a hinged and swingable extension. The pair of scaffold extensions 3630 on the retrofit scaffold base support component 3620 can be configured to rest on the ground or a support surface to provide stability for the connected modified scaffold support component 3600. Additionally, the retrofit scaffold base support component 3620 can provide stabilizing bracing and safety bracing for the scaffold support component 3600. Moreover, the retrofit scaffold base support component 3620 can serve as a support outrigger, a work platform, and a materials staging area.

Figure 37:
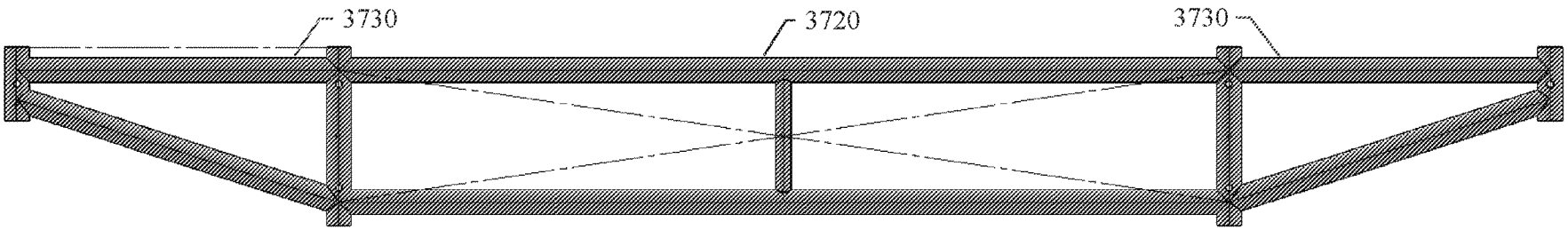
FIG. 37 illustrates a retrofit scaffold base support component having a two-sided scaffold extension with fixed extensions to provide structural support and safety bracing according to an embodiment disclosed herein.

FIG. 37 illustrates a retrofit scaffold base support component 3720 having a two-sided scaffold extension 3730 with fixed extensions according to an embodiment disclosed herein. In the example embodiment of FIG. 37, the retrofit scaffold base support component 3720 can be mounted on or coupled with other scaffold support components via scaffold mount couplings as shown and described herein. As a result, the connected scaffold support components can provide two pairs of scaffold extensions, wherein the pairs of scaffold extensions can be fixed extensions or hinged and swingable extensions. It will be apparent to those of ordinary skill in the art in view of the disclosure herein that any of the scaffold components and/or scaffold extensions as described herein can be connected in various combinations to adapt to a particular application in which they are used. As such, the scaffold components and scaffold extensions as described herein can provide a variety of adaptable configurations and scaffold structures. Additionally, the retrofit scaffold base support component 3720 can provide stabilizing bracing and safety bracing for virtually any scaffold support assembly with which the retrofit scaffold base support component 3720 is used. Moreover, the retrofit scaffold base support component 3720 can serve as a support outrigger, a work platform, and a materials staging area.

Figure 38:
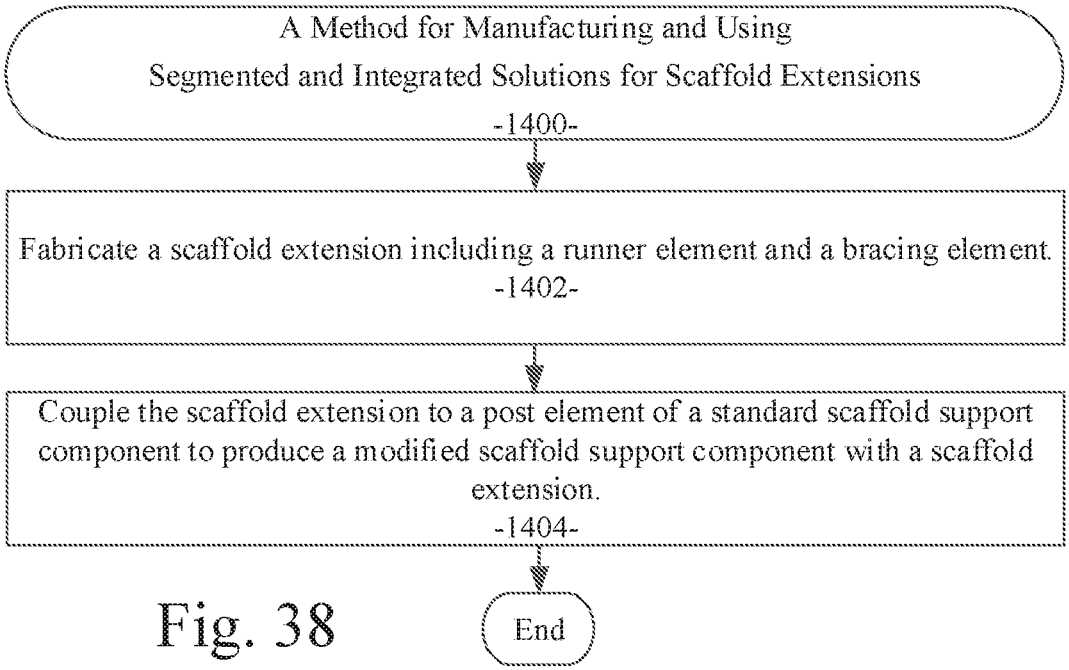
FIG. 38 is a flowchart illustrating an example method for manufacturing a scaffold extension according to an example embodiment.

Referring now to FIG. 38, a flow chart illustrates an example embodiment of a method 1400 as described herein. The method 1400 of an example embodiment includes: fabricating a scaffold extension including a runner element and a bracing element (method block 1402); and coupling the scaffold extension to a post element of a standard scaffold support component to produce a modified scaffold support component with a scaffold extension (method block 1404).

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. An apparatus comprising:

a retrofit scaffold support component including at least one post element and coupling joints at both ends of the post element, the retrofit scaffold support component configured for coupling to a post of a standard scaffold support component at the coupling joints, the coupling joints configured to slide over or into the post of a standard scaffold support component, the retrofit scaffold support component including a plurality of retrofit scaffold runner elements coupled to the post element; and a scaffold extension including an extension runner element and an extension bracing element coupled to the post element of the retrofit scaffold support component to produce a modified parallel retrofit scaffold support component with a scaffold extension, the scaffold extension and the bracing element each being coupled to the post element of the retrofit scaffold support component with a hinged and swingable coupling, both of the hinged and swingable couplings being captured between the retrofit scaffold runner elements, the hinged and swingable coupling being a cylindrical component configured to wrap around at least a portion of the post element of the retrofit scaffold support component.

2. The apparatus of claim 1 wherein the scaffold extension is a one-sided scaffold extension or a two-sided scaffold extension.

3. The apparatus of claim 1 wherein the retrofit scaffold support component is coupled to the standard scaffold support component at the coupling joints.

4. The apparatus of claim 1 wherein the hinged and swingable coupling enables the scaffold extension to swing horizontally, pivoting around the post element.

5. The apparatus of claim 1 wherein the hinged and swingable coupling enables the scaffold extension to swing horizontally a full 360 degrees around the post element.

6. The apparatus of claim 1 wherein the scaffold extension includes an outboard coupling joint configured with a receiver coupling joint to receive a post element from a different scaffold support component.

7. The apparatus of claim 1 wherein the scaffold extension includes an outboard coupling joint configured to support an object from the group consisting of: a handrail, a walkway, a tools or materials platform, a pulley assembly, a lifting apparatus assembly, and a building anchor.

8. The apparatus of claim 1 wherein the retrofit scaffold support component includes a plurality of post elements and a scaffold extension hinged and swingably coupled to each of the plurality of post elements of the retrofit scaffold support component.

* * * * *